US011872503B2

(12) United States Patent
MacDonald et al.

(10) Patent No.: US 11,872,503 B2
(45) **Date of Patent: *Jan. 16, 2024**

(54) CIRCUIT BLOCKS

(71) Applicant: Tenka Inc., Willits, CA (US)

(72) Inventors: Nathaniel W. MacDonald, Mill Valley, CA (US); John F. Schuster, San Francisco, CA (US)

(73) Assignee: Tenka Inc., Willits, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/654,893

(22) Filed: Mar. 15, 2022

(65) Prior Publication Data

US 2022/0203253 A1 Jun. 30, 2022

Related U.S. Application Data

(60) Division of application No. 16/694,360, filed on Nov. 25, 2019, now Pat. No. 11,291,925, which is a (Continued)

(51) Int. Cl.
*A63H 33/04* (2006.01)
*A63H 33/08* (2006.01)

(52) U.S. Cl.
CPC ..... *A63H 33/042* (2013.01); *A63H 33/046* (2013.01); *A63H 33/086* (2013.01); *A63H 33/088* (2013.01)

(58) Field of Classification Search
CPC .. A63H 33/042; A63H 33/046; A63H 33/086; A63H 33/088

(Continued)

(56) References Cited

U.S. PATENT DOCUMENTS 3,696,548 A 10/1972 Teller
5,908,328 A 6/1999 Chen (Continued)

FOREIGN PATENT DOCUMENTS

CN 103611325 A 3/2014
CN 205095419 3/2016
CN 103933742 1/2017

OTHER PUBLICATIONS

Chinese Office Action dated Nov. 17, 2021 for CN Application No. 202011283238, 8 pages with English Translation and First Search Report.

(Continued)

*Primary Examiner* — Joseph B Baldori
(74) *Attorney, Agent, or Firm* — TraskBritt

(57) ABSTRACT

Circuit blocks are provided. A circuit block may include a substrate and at least one electrical component mounted on the substrate. The circuit block may also include a non-conductive frame coupled to the substrate, and at least one post coupled to the substrate and extending from the substrate and through at least a portion of the frame in a first direction substantially perpendicular to the major surface of the substrate. Moreover, the circuit block may include a contact coupled to a second, opposite surface of the substrate and including a corner section projecting outwardly from the frame and extending in at least two directions substantially perpendicular to a longitudinal axis of the at least one post. The block may also include at least one magnet positioned proximate the flexible corner section of the contact and configured to magnetically attract at least one other circuit block.

20 Claims, 20 Drawing Sheets

Related U.S. Application Data continuation of application No. 15/482,471, filed on Apr. 7, 2017, now Pat. No. 10,512,853.

(60) Provisional application No. 62/320,435, filed on Apr. 8, 2016.

(58) Field of Classification Search
USPC ..... 446/90, 91, 92, 137
See application file for complete search history.

(56) References Cited

U.S. PATENT DOCUMENTS

| | | | |
|---|---|---|---|
| 6,062,937 | A | 5/2000 | Kikuchi |
| 6,150,808 | A | 11/2000 | Yagyu et al. |
| 7,322,873 | B2 | 1/2008 | Rosen et al. |
| 7,611,357 | B2 | 11/2009 | Han et al. |
| 7,846,002 | B1 | 12/2010 | Mikesell et al. |
| 8,651,913 | B1 | 2/2014 | Chia-Yen |
| 8,690,631 | B2 | 4/2014 | Nag |
| 9,016,902 | B1 | 4/2015 | Lin et al. |
| 9,017,132 | B2 | 4/2015 | Lin |
| 9,019,718 | B2 | 4/2015 | Bdeir |
| 9,209,560 | B2 | 12/2015 | Wei |
| 9,320,980 | B2 | 4/2016 | Schweikardt et al. |
| 9,419,378 | B2 | 8/2016 | Bdeir |
| 9,457,287 | B1 | 10/2016 | Lin et al. |
| 9,597,607 | B2 | 3/2017 | Bdeir |
| 9,755,356 | B1 | 9/2017 | Kim et al. |
| 9,814,998 | B2 | 11/2017 | Wei |
| 9,914,065 | B2 | 3/2018 | Almog et al. |
| 10,047,940 | B2 | 8/2018 | Grunzweig et al. |
| 10,411,424 | B2 | 9/2019 | Chia-Yen |
| 10,512,853 | B2 * | 12/2019 | MacDonald ..... A63H 33/046 |
| 11,291,925 | B2 * | 4/2022 | MacDonald ..... A63H 33/088 |
| 2003/0067365 | A1 | 4/2003 | Kawanami et al. |
| 2006/0134978 | A1 | 6/2006 | Rosen et al. |
| 2007/0184722 | A1 | 8/2007 | Doherty |
| 2008/0068816 | A1 | 3/2008 | Han et al. |
| 2009/0015361 | A1 | 1/2009 | Tremblay et al. |
| 2011/0204883 | A1 | 8/2011 | Konno et al. |
| 2012/0252307 | A1 | 10/2012 | Chia-Yen |
| 2013/0109268 | A1 | 5/2013 | Chia-Yen |
| 2013/0163235 | A1 | 6/2013 | Chuang |
| 2013/0264699 | A1 | 10/2013 | Mills et al. |
| 2013/0343025 | A1 | 12/2013 | Bdeir |
| 2014/0349544 | A1 | 11/2014 | Chien et al. |
| 2016/0101370 | A1 | 4/2016 | Madsen et al. |
| 2016/0220919 | A1 | 8/2016 | Almog et al. |
| 2016/0325200 | A1 | 11/2016 | Lu |
| 2017/0036132 | A1 | 2/2017 | Yang et al. |
| 2018/0056205 | A1 | 3/2018 | Lu |
| 2018/0221782 | A1 | 8/2018 | Almog et al. |
| 2019/0054388 | A1 | 2/2019 | Cranias et al. |
| 2019/0232185 | A1 | 8/2019 | Lin et al. |

OTHER PUBLICATIONS

International Search Report & Written Opinion for PCT Application No. PCT/US2017/026698, dated Aug. 17, 2017, 11 pages.

* cited by examiner

CIRCUIT BLOCKS

CROSS-REFERENCE TO RELATED APPLICATIONS

This application is a divisional of U.S. patent application Ser. No. 16/694,360 filed Nov. 25, 2019, now U.S. Pat. No. 11,291,925, issued on Apr. 5, 2022, which is a continuation of U.S. patent application Ser. No. 15/482,471, filed Apr. 7, 2017, now U.S. Pat. No. 10,512,853, issued Dec. 24, 2019, which claims the benefit under 35 U.S.C. § 119(e) of U.S. Provisional Patent Application Ser. No. 62/320,435, filed Apr. 8, 2016, titled "Manipulable Circuit Building Blocks," the disclosure of each of which is hereby incorporated herein in its entirety by this reference.

TECHNICAL FIELD

The embodiments discussed herein relate to circuit blocks. In particular, various embodiments relate to circuit building blocks. Further, various embodiments relate to contacts for circuit building blocks.

BACKGROUND

Various entities, such as educational toy companies, that provide learning tools are working to create products that are fun and educational.

The subject matter claimed herein is not limited to embodiments that solve any disadvantages or that operate only in environments such as those described above. Rather, this background is only provided to illustrate one example technology area where some embodiments described herein may be practiced.

BRIEF SUMMARY

According to one embodiment, a device may include a corner section, which includes an outer edge and an inner edge, opposite the outer edge. The corner section may include a flexible, conductive material configured to be displaced in response to a force applied to the outer edge. The device may further include at least one additional section extending from the corner section, and at least one tab coupled to the at least one additional section and configured to electrically couple to a substrate. The device may also include a retainer section opposite the corner section and configured to electrically couple to the substrate. The inner edge of the corner section, the at least one additional section, and the retainer section may be configured to form an inner region configured to receive and retain a magnet.

Further, another embodiment may include a device including a circuit block. The circuit block may include an electrically conductive post and may be configured for coupling to at least one other circuit block. The device may further include a contact configured to electrically couple to the conductive post and include a corner section extending in at least two directions substantially perpendicular to a longitudinal axis of the post. For example, the corner section may extend in a first direction and a second direction, wherein the first direction and the second direction are separated by an angle, such as a 90-degree angle. In some embodiments, the corner section may include a flexible corner section. In addition, the circuit block may include a magnet at least partially retained by the contact and configured to be positioned proximate the corner section of the contact. The magnet, and possibly the flexible corner section, may be configured to magnetically attract at least one other circuit block.

In yet another embodiment, a device may include a circuit block including a substrate, at least one electrical component mounted on a first major surface of the substrate, and a non-conductive frame coupled to the substrate. The circuit block may further include at least one post mechanically coupled to the substrate and electrically coupled to the at least one electrical component. The at least one post may extend from the substrate and through at least a portion of the frame in a first direction substantially perpendicular to the major surface of the substrate. Further, the circuit block may include a contact electrically coupled to a second, opposite surface of the substrate and include a corner section projecting outwardly from the frame and extending in at least two directions substantially perpendicular to a longitudinal axis of the at least one post. For example, the corner section may comprise a flexible corner section. The circuit block may also include at least one magnet positioned proximate the flexible corner section of the contact and configured to magnetically attract at least one other circuit block.

The object and advantages of the embodiments will be realized and achieved at least by the elements, features, and combinations particularly pointed out in the claims.

It is to be understood that both the foregoing general description and the following detailed description are exemplary and explanatory and are not restrictive of the invention, as claimed.

DETAILED DESCRIPTION

Figure 1:
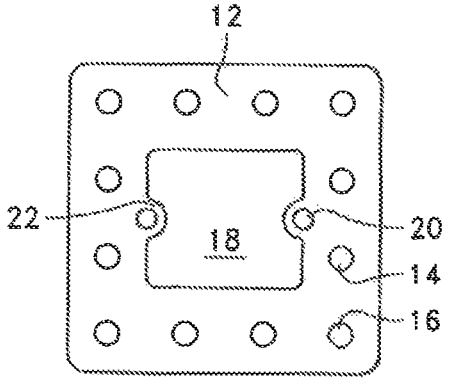
FIG. 1 is a plan view of an example substrate forming the basis of an embodiment of a block.

Various embodiments of the disclosure relate to circuit blocks that may include at least one electrical component. The circuit blocks, which may also be referred to herein as "building blocks," "circuit building blocks," "tiles," "cubes," or simply "blocks," may further include one or more components (e.g., contacts and/or posts) for coupling (e.g., mechanically, magnetically, and/or electrically) to another device, such as another circuit block and/or a third-party device, such as a LEGO®.

Various embodiments of the disclosure may be incorporated into a novel educational circuitry building set (also referred to herein as an "instructional set" or a "play set") that allows individuals to learn circuitry, to see what electrical components look like, and/or to build in three dimensions. A building set may include a plurality of circuit blocks, in accordance with various embodiments disclosed herein. The building set may also include wires or other devices. As will be shown, aspects of the structure of the blocks may enable both mechanical and structural assembly as well as electrical functions and current flow. In some embodiments, two or more blocks may be assembled (e.g., mechanically) in three dimensions ("3D") meaning they may be stacked as well as placed side by side and corner to corner. The blocks may further include coupling holes enabling the block to integrate (e.g., directly) with other building blocks, including, but not limited to, LEGOs®. An individual block may include an electrical component such as a battery, light bulb, motor, switch, etc., and multiple blocks may be coupled in series and/or in parallel and current may flow between blocks that are side by side, corner to corner, and/or stacked. Electrical components, and possibly one or more wires, may be visible to a user. Two or more blocks may be electrically coupled (e.g., directly) to one another (e.g., via one or more contacts) and/or by connecting a wire between them. A building set may allow a user (e.g., children as well as novice adults) to learn about circuitry, see the electrical components, visually trace the current flow, and freely build in 3D.

An instructional set, or play set, may include a plurality of circuit blocks, which can be manually arranged to form different circuits. Different blocks may include different electrical (including electronic) components such as batteries, light-emitting diodes, motors, integrated circuits, and other electrical and electronic elements. An electrical component may include terminals, which are electrically coupled to posts for interconnection to other blocks.

In one aspect, one or more posts of a block may be configured as supports for vertically stacked blocks.

In a further aspect, magnets associated with, and possibly contacting the posts at one or more corners of a block, may attract blocks together. If a magnet protrudes from a side of the block, the magnet may serve as electrical contact between the blocks. Alternatively or additionally, electrical contact may be made through further projecting electrical contact pads on the sides of the blocks. Ferromagnetic discs or other ferromagnetic bodies may be substituted for some of the corner magnets.

In yet further aspects, magnets may surround ferromagnetic posts and the blocks may be configured so that in a stacked structure, the post of a lower-level block contacts the post of an upper-level block, both to support it and to make electrical contact. Magnets may facilitate structural and electrical coupling of two posts.

Embodiments of the present disclosure are explained with reference to the accompanying drawings.

Figure 7:
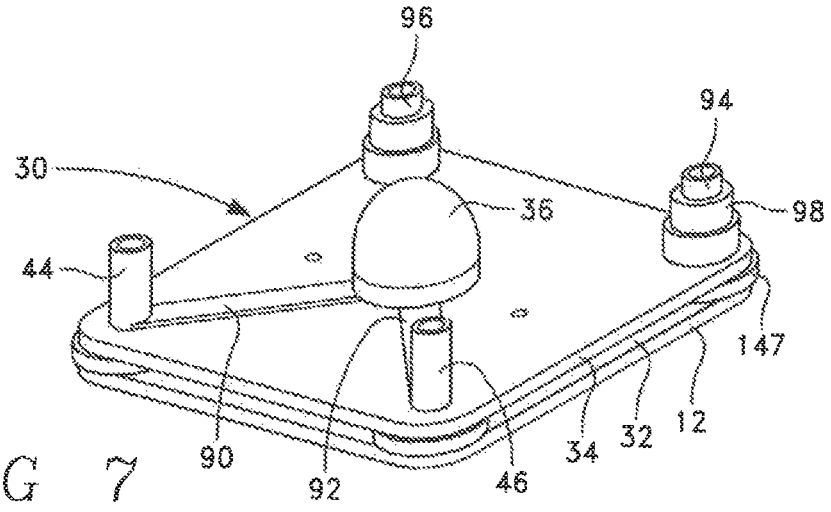
FIG. 7 is an orthographic view of the LED block of FIG. 3.

An example of a circuit block 30, illustrated in the orthographic view of FIG. 7, may be formed of a size that is easily handled, for example, from 2 cm to 10 cm on its lateral sides and 0.2 cm to 4 cm thick. Circuit blocks may be sized to allow the blocks to be easily moved manually while providing good mechanical rigidity. In some embodiments, a block may include, as shown in the plan view of FIG. 1, a substrate 12 of solid material that forms the base of a block and may be configured to couple to another device (e.g., LEGOs® or other building blocks). The substrate material may comprise electrically insulating material, such as plastic, ceramic, printed circuit board, printed wiring board, wood, or any other suitable material. In some embodiments, metal substrates may be used if care is taken to avoid electrical shorts. In the illustrated square substrate 12, side vias or coupling holes 14 may be formed adjacent the four lateral sides and corner coupling holes 16 may be formed adjacent the four corners. A central aperture 18 may allow for easy mechanical mounting of an electrical component or a further support layer on two opposed tabs 22 of the substrate 12 having respective mounting holes 20 and projecting inwardly into the aperture 18. In this particular embodiment, the coupling holes 14, 16, the aperture 18, and the mounting holes 20 may extend through the substrate 12 so that the bottom has the same structure. If the coupling holes 14, 16 were extended into a full two-dimensional square array, the mounting holes 20 may fall between the coupling holes and the aperture 18 may include all the non-peripheral coupling holes.

Figure 2:
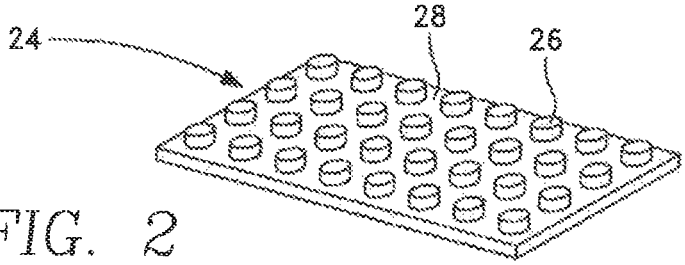
FIG. 2 is an orthographic view of an example LEGO® block that can be mated with a circuit block.

The substrate 12 of the block may be configured to be mounted on a standard building block 24 (e.g., a LEGO®, a MEGA BLOK®, a Kazi™ block), an example of which is illustrated in the orthographic view of FIG. 2, formed of, for example, plastic and having cylindrical studs 26 which project from its otherwise substantially planar upper surface 28 and are arranged in a rectangular array. The side and corner coupling holes 14, 16 of the substrate 12 may be formed to match the LEGO® studs 26 (e.g., 3/16" holes arranged in a square or rectangular array on a spacing of 5/16" so that the coupling holes 14, 16 of the substrate 12 can be force fit onto the studs 26 of the LEGO® block 24). In one example of this embodiment, when the substrate 12 is pressed onto the LEGO® block 24, the aperture 18 overlies the inner studs 26 of the LEGO® block so the substrate 12 can be made flush with the planar upper surface 28 of the LEGO® block 24. Also, the mounting holes 20 of the substrate 12 may fall between the studs 26 of the LEGO® block 24. In general, the substrate 12 may be coupled to a LEGO® block in any manner that allows at least one stud 26 to fit into one or more coupling holes 14, 16. The block may be mounted to building blocks, such as LEGO® blocks, MEGA BLOKS®, Kazi™ blocks, or other building blocks having compatible studs and/or recesses.

The electrical component of a block may be mounted on (e.g., directly on) the illustrated substrate 12 and wiring may connect from the electrical component to posts fit into the corner coupling holes 16. However, manufacture may be facilitated by dividing the substrate 12 into separate planar layers or alternatively joining additional generally planar layers to the substrate 12. For example, as illustrated in the side cross-sectional view of FIG. 3, an LED circuit block 30, that is, a block including a light-emitting diode (LED), includes the substrate 12 joined to a spacer plate 32 and a mounting plate 34 by one or more attachment devices (e.g., two flat-head screws). The attachment devices may be sunk into countersinks around the mounting holes 20 on the bottom of the tabs 22 and pass through the mounting holes 20 and through corresponding holes in the spacer plate 32 and are screwed into tapped holes in the mounting plate 34 to thereby screw together the substrate 12 and the spacer and mounting plates 32, 34. A gap 35 may be formed in the spacer plate 32 adjacent the mounting plate 34 between the magnets 147 although other portions of the spacer plate 32 may nearly abut the mounting plate 34 when they are screwed together. The spacer plate 32 and mounting plate 34 may include non-conducting materials such as plastic. An electrical component 36, such as an LED lamp or other lamps (e.g., incandescent lamp), may be fixed to the mounting plate 34. The electrical component 36 is encapsulated in a transparent plastic body 38. Two electrical leads 40, 42 for the electrical component 36 project from its bottom for separate electrical connection to two electrical posts 44, 46, hereinafter referred to simply as posts, fit into two of the corner coupling holes 16. In alternative embodiments, two or more of the substrate 12, spacer plate 32, and mounting plate 34 may be combined; or one or more of the substrate 12, spacer plate 32, and mounting plate 34 may be eliminated.

Figure 3:
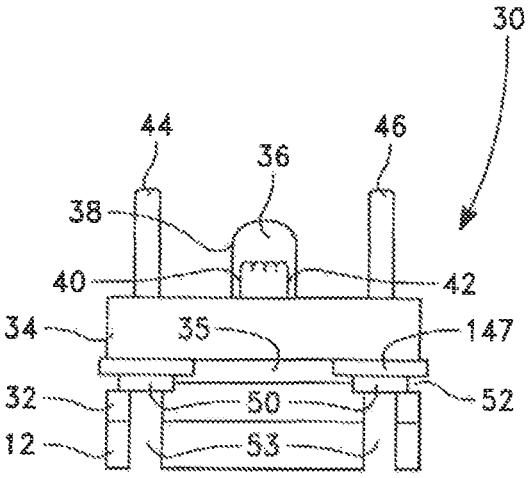
FIG. 3 is side, cross-sectional view of an example block mounting a light-emitting diode.
Figure 4:
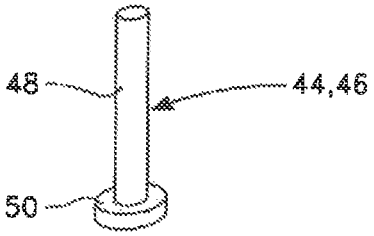
FIG. 4 is an orthographic view of an example post.

An example of the electrical post 44, 46 illustrated in the orthographic side view in FIG. 4 includes a post shaft 48 and a head 50. The post shaft 48 may be sized for tight fitting into a generally cylindrical receiving hole or may be threaded for screwing into a tapped receiving hole. Other mating configurations such as fluted surfaces or spade posts and rectangular receiving holes are possible. An indentation 52 in the spacer plate 32 of FIG. 3 accommodates the head 50, and other elements may fit on the post shaft 48 and is sized so that, when screws fix the substrate 12 to the mounting plate 34, the head 50 may be tightly captured between the spacer plate 32 and the mounting plate 34. The electrical connections between the electrical leads 40, 42 of the electrical component 36 and the electrical posts 44, 46 may be made by any number of means including conducting strips positioned on the top surface of the mounting plate 34, wires soldered or press fit against the electrical posts 44, 46 or by connectors crimped to the ends of the respective electrical leads 40, 42 and fit around and contacting the heads 50 or the post shafts 48 of the electrical posts 44, 46. The post shafts 48 may project from the free surface of the mounting plate 34 a length at least equal to the height of the electrical component 36, such as, in this case, the LED lamp.

The mounting plate 34 may be a printed circuit board (PCB) and the electrical connections between the electrical leads 40, 42 of the electrical component 36 and the electrical posts 44, 46 may be traces on the PCB. The electrical component 36 may be soldered to the PCB and the electrical posts 44, 46 may be either soldered or press fit into metallized through holes in the PCB. Access holes 53 including the corner coupling holes 16 may be formed in the substrate 12 and spacer plate 32 to at least partially expose the bottom of the heads 50. The diameters of the access holes 53 may be larger than the diameters of the post shafts 48 to allow the top of another post shaft 48 to be inserted from the bottom of the substrate 12 and contact the illustrated post head 50.

Figure 5:
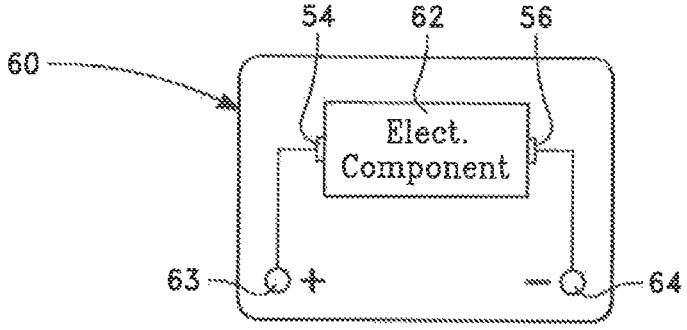
FIG. 5 is an electrical circuit schematic of an example block.

FIG. 5 illustrates an electrical circuit schematic 60 for a block with two electrically coupled posts 63, 64. The circuit includes a two-terminal electrical component 62 including first and second terminals 54, 56. The first terminal 54 is coupled to the first post 63 and the second terminal 56 is coupled to the second post 64. The electrical posts 63, 64 may be configured to couple to other blocks (e.g., via flexible wires coupled to the posts 63, 64 or through the posts 63, 64 to conductive elements detachably contacting the posts 63, 64, or via direct contact between the posts 63, 64 of one block and the posts 63, 64 of another block, or via a combination of wires and direct contact).

Figure 6:
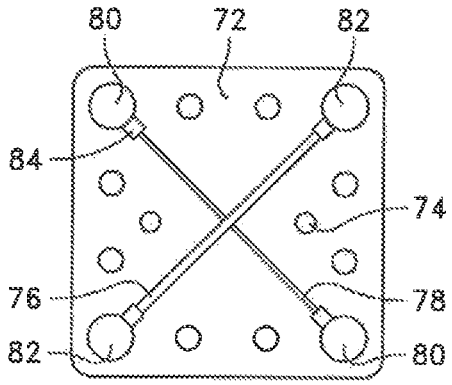
FIG. 6 is a plan view of an example cross-over block.

In other embodiments, a cross-over block includes four posts, each in a corner of the block, and in which the posts at opposite corners are electrically coupled to one another. For example, as illustrated in a bottom plan view in FIG. 6, a cross-over block includes a mounting plate 72, which is coupled to the substrate 12 by mounting screws from the substrate 12 and, for example, screwed into tapped screw holes 74 in the cross-over mounting plate 72. Positioned between the substrate 12 and the mounting plate 72 is a first wire 76 passing across (e.g., over or under) a second wire 78. As a result, the cross-over block may be implemented with only two layers of plates. The first wire 76 is electrically coupled on one diagonal between two posts 82 fit into opposed first corner coupling holes, and the second wire 78 is similarly electrically coupled on the perpendicular diagonal between two electrical posts 80 fit into opposed second corner coupling holes. The heads 50 of the electrical posts 80, 82 are illustrated. In some embodiments, each wire 76, 78 may have each of its ends crimped to a connector 84 having an unillustrated collar surrounding the post shaft 48 of the corresponding electrical post 80, 82. Each wire 76, 78 may be electrically insulated from the other.

A cross-over block may include a substrate 12 and spacer plate 32. Internal recesses formed in the spacer plate 32, in addition to accommodating the post heads, also accommodate the wires 76, 78 and any crimped connectors 84. Additional washers may be inserted between the post heads 50 and the mounting plate 34 to accommodate any non-planar crimped connectors 84. When the mounting plate 34 and substrate 12 are screwed together with the wires 76, 78 and connectors 84 positioned between them, the connectors 84 make sufficient electrical contact with the heads 50 of the electrical posts 80, 82 and the post shafts 48 project from the opposed free surface of the mounting plate 34.

The LED circuit block 30, illustrated in the orthographic view of FIG. 7, includes the electrical component 36 (in this case, an LED lamp) electrically coupled to the two electrical posts 44, 46 by two respective wirings 90, 92. In this embodiment, two additional support posts 94, 96 may be fit into the other two corner coupling holes of the circuit block 30 and may be formed to the same height as the electrical posts 44, 46 to support a next higher block. Since the support posts 94, 96 are not used for electrical coupling, they may be formed of insulating material or may be formed of conductive material and may be optionally surrounded by a stack of insulating rings 98 as shown.

Figure 8:
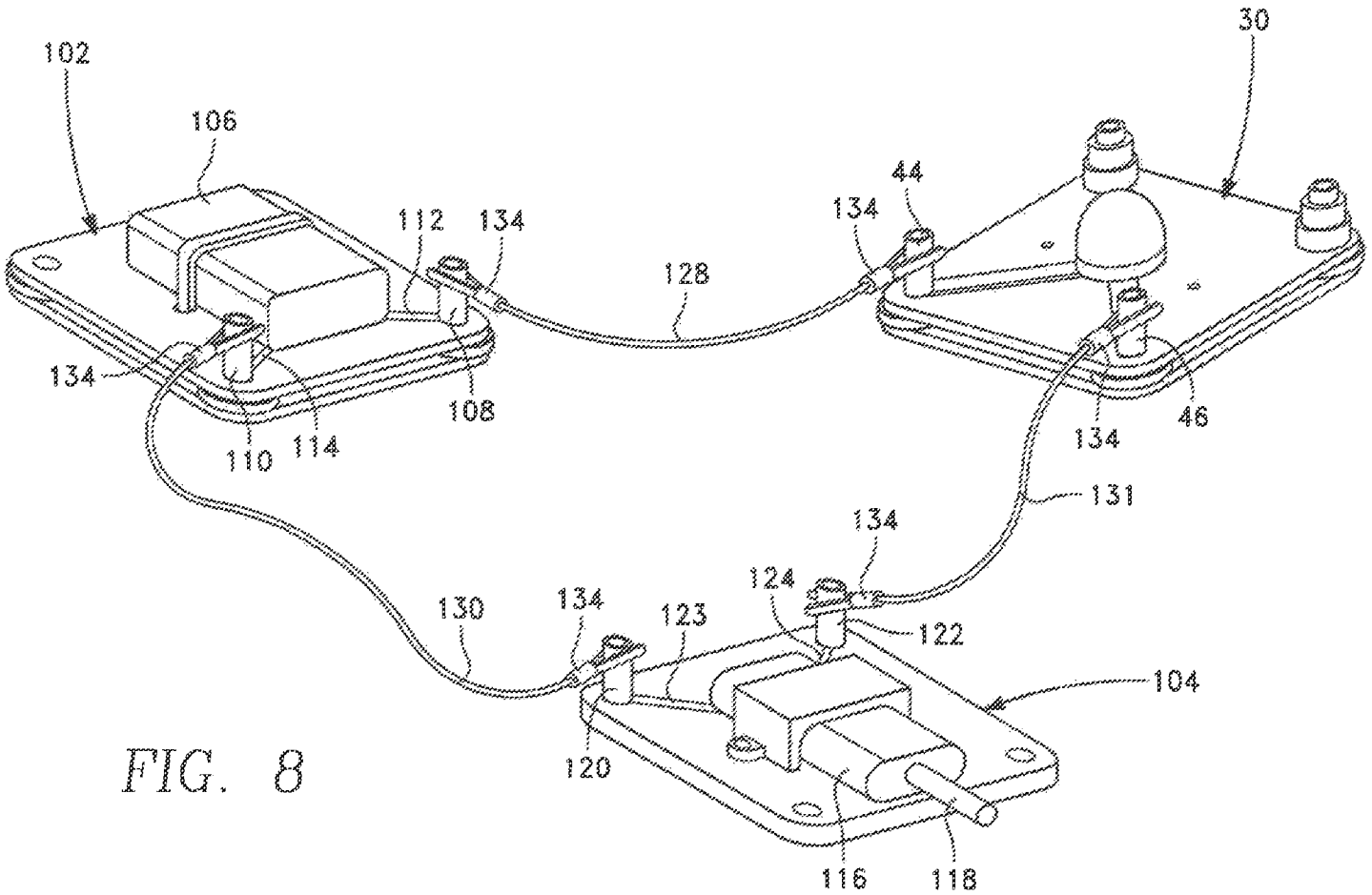
FIG. 8 is an orthographic view of three blocks arranged on a table top and interconnected with removable wires.

The orthographic view of FIG. 8 illustrates an example of three circuit blocks assembled on a planar surface such as a bench or table top. The assembly includes the LED circuit block 30, a battery block 102, and a motor block 104. The battery block 102 includes a battery 106 electrically coupled between two posts 108, 110 in its corner coupling holes by respective electrical wirings 112, 114. The motor block 104 includes an electrical motor 116 having a rotary output shaft 118 and being electrically coupled between two posts 120, 122 by respective wirings 123, 124. Wires 128, 130, 131 selectively couple the blocks 30, 102, 104 in series through alligator clips 134 fixed to stripped ends of the wires 128, 130, 131 and manually clipped onto the electrical posts 44, 46, 108, 110, 120, 122. Other types of removable connections are possible such as spade connections, loop connections, loops of wire around the posts, or any other means of manual connection. The illustrated blocks 30, 102, 104 may include polarity-sensitive components so that the polarities of the inter-connections may be important and may be indicated to the user.

Flexible wires interconnecting different blocks, such as the wires 128, 130, 131 of FIG. 8, may include ferromagnetic or magnetic elements on their ends so that they are attracted either to the magnets in the blocks or to the ferromagnetic electrical posts which may have been magnetized by the associated magnets at their heads. Such ferromagnetic or magnetic tips may simplify the wire connections between blocks and may assist in holding the wires to the electrical posts.

Although FIG. 8 shows a series connection, when the LED circuit block 30 is coupled in parallel with another block, such as the motor block 104, it can be used to monitor the direction of current flow since the light emitting diode lights up only under one direction of current flow. When the direction of current through the motor 116 is reversed, the direction of rotation of its output shaft 118 is visibly reversed and the state of the LED changes.

The circuit blocks disclosed herein may be assembled into assemblies joined in three dimensions to form a single electrical circuit 140 without the use of additional wires. A 3-D assembly illustrated in the orthographic view of FIG. 9 includes the battery block 102 physically and electrically coupled to a stack 142 supported on the same planar bed as the battery block 102 and including the LED circuit block 30, the motor block 104, and a fan block 144 with a fan 145. The wirings contained within each block are not illustrated in FIG. 9. The assembly of FIG. 9 may be straightforwardly generalized to a one-, two-, or three-dimensional array of any combination of single-level blocks and multi-block stacks.

Figure 10:
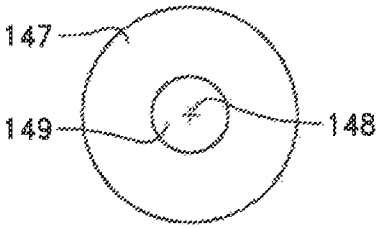
FIG. 10 is a plan view of an example annular magnet fittable around and capturable by the post of FIG. 4.
Figure 9:
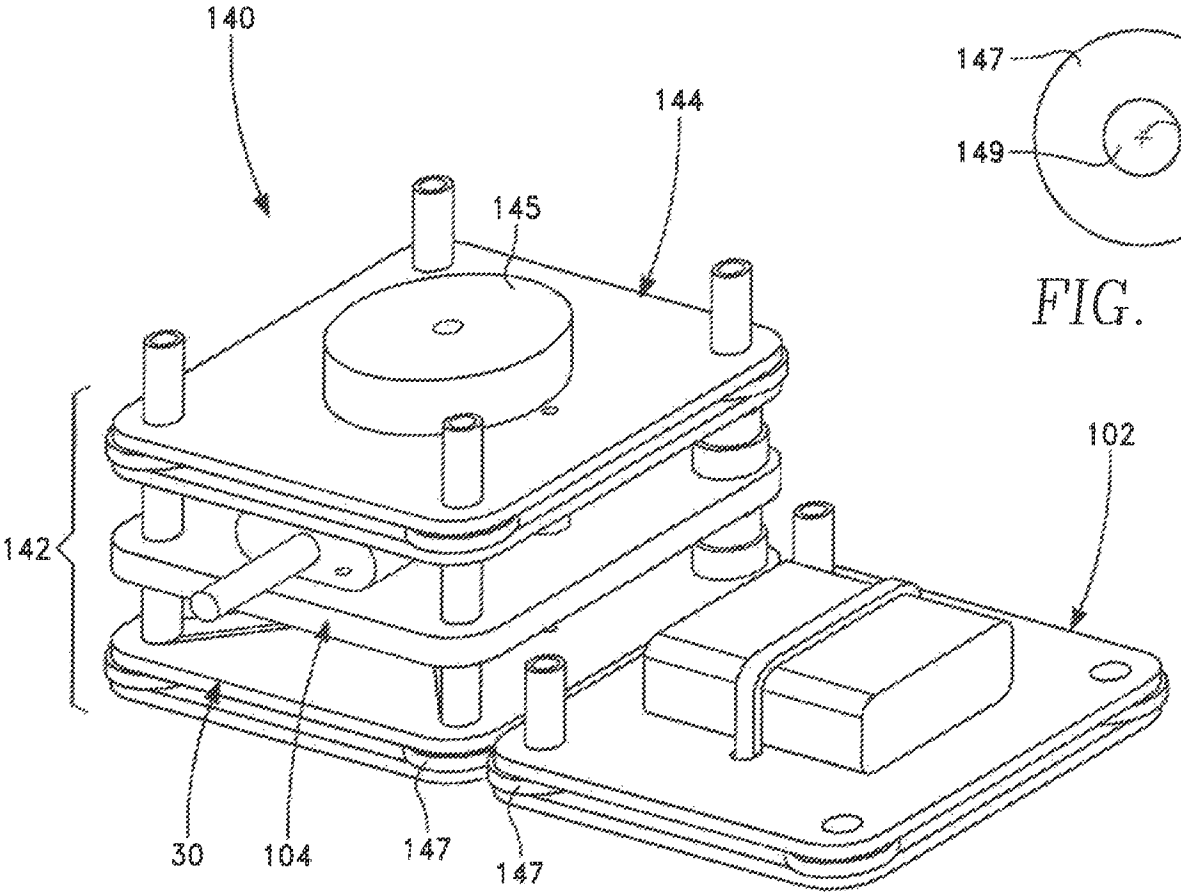
FIG. 9 is an orthographic view of an example interconnected assembly of blocks including three in a vertical interconnected stack connected and joined horizontally to another block.

The physical and electrical coupling of the battery block 102 and the bottom LED circuit block 30 as well as the coupling between the stack 142 of blocks may be facilitated by each block including at its corners annular magnets 147, illustrated in the plan view in FIG. 10, in the side cross sectional view in FIG. 3 and also in the orthographic view of FIG. 9. The annular magnet 147, which is generally concentric about an axis 148 parallel to if not coincident with the axis of the post shaft 48, includes an aperture 149 which fits around the post shaft 48 of the electrical posts 44, 46 or other post such as a ferromagnetic and electrically conductive support post, either loosely or in a force fit. The annular magnet 147 may be magnetized along the axis 148 and, thus, may be magnetically coupled to the ferromagnetic posts 44, 46 as well as to posts of other blocks juxtaposed on the adjacent ends, including on the heads 50. The magnetic coupling between the posts of different levels promotes structural strength in the stack 142 and also thereby promotes electrical coupling between two approximately axially aligned posts 44, 46.

Further, as also illustrated in the side, cross-sectional view of FIG. 3, the outer diameter of the annular magnet 147 may be large enough such that the magnet 147 extends to or slightly beyond the side of the block. Thereby, when two blocks are placed side by side, the magnets 147 in the two blocks may be closely coupled. If the magnetic polarities are chosen such that the nearest points of the juxtaposed magnets have opposite magnetic polarities the two magnets and hence their blocks are attracted to each other and the two magnets touch. If the magnets are also electrically conducting, as most magnets are, touching magnets may provide a conducting path between the posts of the neighboring blocks, for example, blocks 30, 102 in FIG. 9.

Figure 11:
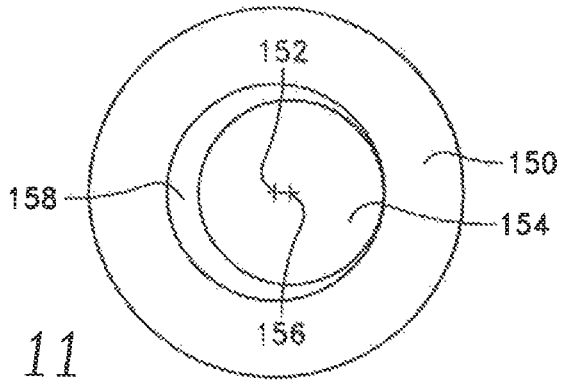
FIG. 11 is a schematic cross-sectional view of an example annular magnet rotatable around and displaceable from a circular post.
Figure 12:
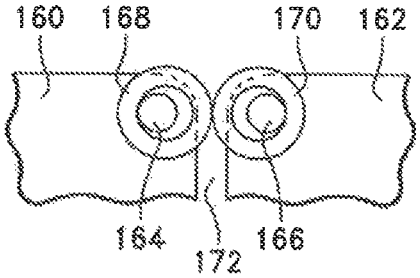
FIG. 12 is a schematic cross-sectional view of two example blocks each incorporating the movable magnet of FIG. 11 and demonstrating the attraction and contact between blocks.

In another embodiment of the magnetic coupling, as illustrated in the plan view of FIG. 11, an annular magnet 150 has an inner radius about its central axis 152 that is larger than the radius of a post 154 about its central axis 156 so as to form a gap 158 between them. The annular magnet 150 may not be clamped inside the block but can freely rotate about its axis 152 as well as move laterally relative to the post 154. An assembly, shown in the plan view of FIG. 12, includes two blocks 160, 162 having respective posts 164, 166 loosely surrounded by movable annular magnets 168, 170 which are magnetized parallel to respective diagonals in the plane of the movable annular magnet 168, 170. When the corners of the two blocks 160, 162 are manually placed near one another, the movable annular magnets 168, 170 are attracted to each other and may cause each other to rotate such that the magnetization directions become aligned and the attractive force causes the movable annular magnets 168, 170 to touch and establish electrical contact between them. If the posts 164, 166 are ferromagnetic, the inner annular surfaces of the movable annular magnets 168, 170 may be drawn to the respective posts 164, 166 while their outer annular surfaces of the movable annular magnets 168, 170 maintain contact with each other so that sufficient electrical contact may be made between the movable annular magnets 168, 170 and posts 164, 166, thereby establishing a conductive path between the blocks 160, 162. Even though the movable annular magnets 168, 170 are touching, a gap 172 may form between the blocks 160, 162. The movable annular magnets 168, 170 may alternatively be magnetized along their respective vertical axes with the magnets at adjacent corners having opposite up/down magnetic polarities.

Figure 13:
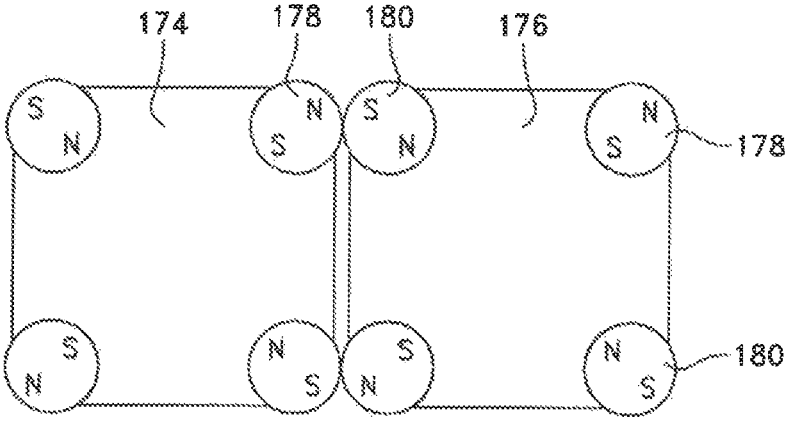
FIG. 13 is a schematic plan view of two example blocks having diagonally magnetized magnets at their corners to provide attraction and contact.

The attractive magnets may be in the form of right circular cylinders. In one embodiment illustrated schematically in the plan view of FIG. 13, two blocks 174, 176 have cylindrical magnets 178, 180 fixedly embedded in their respective block corners. The magnets 178, 180 may be horizontally magnetized in directions along the diagonals of the blocks 174, 176 (e.g., magnetized such that adjacent corners of the two blocks 174, 176 have opposite magnetic polarities to each other). In the illustrated embodiment, the magnets 178 may have inwardly facing south poles S and the magnets 180 may have inward facing north poles N and the magnets 178, 180 may alternate around the edges of the blocks 174, 176. If the blocks are manually moved such that an inwardly facing S-pole magnet 178 is near an inwardly facing N-pole magnet 180, the two blocks 174, 176 are attracted to each other until their magnets 178, 180 touch. This configuration of magnetic orientations also applies to horizontally magnetized annular magnets with electrical posts at their center, which may provide both structural and electrical contact between the blocks 174, 176. Related embodiments use axially (vertically) magnetized magnets with upwardly facing S-pole magnets 178 and upwardly facing N-pole magnets 180, in which embodiment the magnets 178, 180 may either be cylindrical or be annular and surrounding respective posts.

Figure 14:
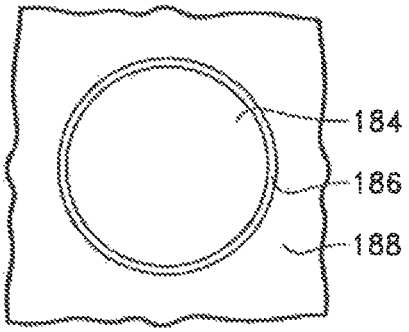
FIG. 14 is a cross-sectional view of an example spherical magnet captured in a block.

In another embodiment involving a self-orienting magnet, as illustrated in the cross-sectional view of FIG. 14, a ball magnet 184 of generally spherical shape is at least partially enclosed in a cavity 186 of a block 188 or other body. The cavity 186 has dimensions slightly larger than that of the ball magnet 184 so that the ball magnet 184 is captured but can freely rotate. The cavity 186 may be spherical, partially spherical, cubic, or other shape such that the ball magnet 184 is captured but can freely rotate. The ball magnet 184 may be magnetized along an axis that can rotate with the ball magnet 184. The ball magnet 184 may be partially exposed at the surface or edge of the block 188 so that the cavity 186 is only partial or the ball magnet 184 may be completely enclosed. Similarly to the previously described embodiments, multiple ball magnets 184 can be disposed at the corners of a circuit block.

Depending on the embodiment, the magnets may have almost any shape or size. For example, the magnets may be a disk, a cylinder, a rectangular body, a ball, a half disk, a half ball, be concave, convex or other shape. The magnets of the same block or of different blocks may have the same shape or may be different. The magnets may be magnetized radially, axially, vertically, horizontally, diagonally, or with any orientation that enables blocks to be attracted to one another.

Figure 15:
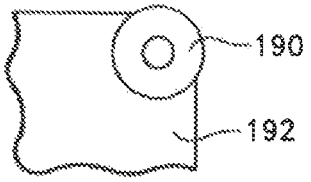
FIG. 15 is a schematic plan view of an example block incorporating a ferromagnetic washer.

In a further embodiment, one or more of the magnets may be replaced by a conductive, ferromagnetic member. For example, as illustrated in the plan view of FIG. 15, a ferromagnetic member, such as an iron washer 190, may be positioned at one corner of a block 192 and may slightly protrude from the corner. The ferromagnetic member may be attracted to almost any other magnet in an adjacent block. Iron and most other ferromagnetic material are electrically conductive so that the ferromagnetic couplers may also serve as electrical couplers between blocks. Ferromagnetic couplers may be alternated on a same block with magnets. In one such embodiment, two opposed corners of a block may include magnets and the other two opposed corners may include ferromagnetic couplers. Such a configuration allows all the magnets to have the same magnetization direction, whether vertical or horizontal.

Figure 16:
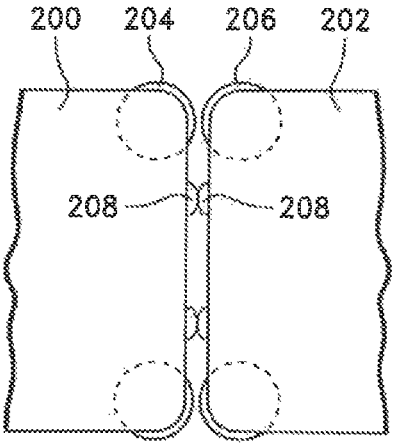
FIG. 16 is a plan view of two example horizontally arranged blocks utilizing less protruding corner magnets for attraction and separate, more protruding, contacts for electrical connection.

Another embodiment, illustrated in the plan view of FIG. 16, separates the mechanical and electrical coupling between horizontally arranged blocks 200, 202. Each block corner may include freely rotatable magnets 204, 206, preferably horizontally magnetized and constrained to rotate in a horizontal plane, and which protrude from the sides of the blocks 200, 202. When the blocks 200, 202 are brought together with their corners somewhat aligned, the magnets 204, 206 rotate and attract each other so as to bring the blocks toward each other. However, contact bumps 208 are formed in each block 200, 202 to protrude from the block sides. The contact bumps 208 may include any conductive material and need not be magnetic. The protrusion of the contact bumps 208 from the blocks 200, 202 may be slightly greater than the protrusion of the magnets 204, 206 so that the magnetic attraction between the magnets 204, 206 may cause the contact bumps 208 of neighboring blocks 200, 202 to contact and limit further movement and to make electrical contacts between the blocks 200, 202. Depending on the geometry of the ends of the contact bumps 208, further magnetic movement may be limited such that the magnets 204, 206 remain slightly apart or there may be some lateral movement, illustrated in the vertical direction, bringing the magnets 204, 206 into physical contact. Alternatively or additionally, the contact bumps 208 may be flexible such that they deform and maintain electrical contact but allow the magnets to come into contact.

Figure 17:
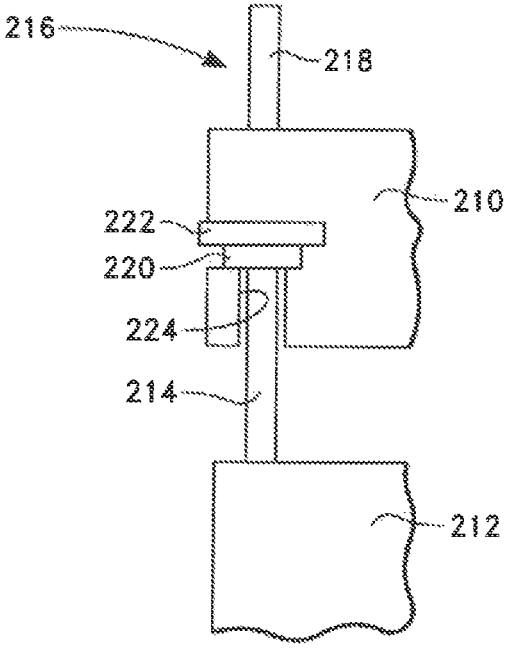
FIG. 17 is a schematic cross-sectional side view generally corresponding to FIG. 3 showing the vertical support and electrical contacts between blocks through their ferromagnetic posts.

In the stack 142 of FIG. 9, the posts may provide both vertical support and vertical electrical contact between blocks in the stack. As illustrated in the cross-sectional side view of FIG. 17, an upper block 210 is supported on and electrically contacted to a lower block 212 through a post 214, which may include ferromagnetic material such as steel, iron, or nickel. The post 214 is sufficiently sized to span any electrical component and wiring on the lower block 212. The upper block 210 may similarly include a ferromagnetic electrical post 216 having a shaft 218 protruding from its top and a head 220 facing the bottom of the upper block 210. The shaft 218 projects upwardly from the head 220 and passes through a magnet 222 and a pass hole in the upper block 210. By means of the structure of FIG. 3 or other means, the bottom of the head 220 is captured in the upper block 210 adjacent to and above an access hole 224.

When the blocks 210, 212 are vertically stacked, the shaft of the post 214 of the lower block 212 is fit into the access hole 224 of the upper block 210 and it contacts the lower surface of the post head 220 of the upper block 210. Just the weight of the upper block 210 may be sufficient to make electrical contact between the lower post 214 and the head 220 of the upper post 216. The magnet 222, which may be vertically or horizontally magnetized, may provide even more secure physical support and electrical contact as it magnetizes the lower ferromagnetic post 214 and ferromagnetic post head 220 of the upper post 216 and may cause the blocks 210, 212 to draw more tightly toward each other.

Figure 18:
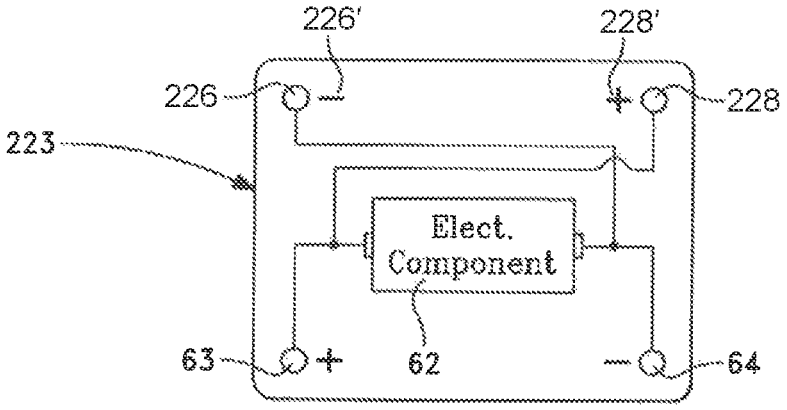
FIG. 18 is an electrical circuit schematic of a block including both an electrical component and a cross-over connection between posts.

As illustrated in the electrical schematic of FIG. 18, a cross-over may be incorporated into a block 223 having the electrical component 62 and electrically coupled posts 63, 64 of FIG. 5. The block 223 may additionally include cross-over wiring to terminals 226, 228 with their separate polarity indicia 226', 228'. This configuration may be particularly useful in the stacked arrangement of FIG. 9.

If the electrical component is more complex, such as a 3-terminal transistor or multi-terminal integrated circuit, more than two posts may be needed for the inputs and outputs of the device.

Figure 19:
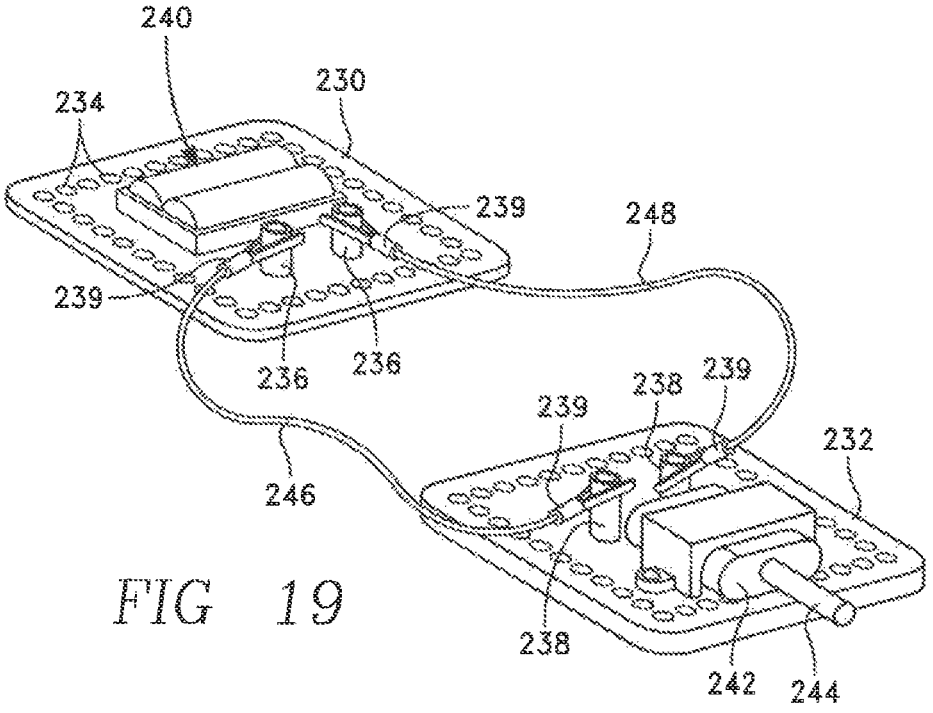
FIG. 19 is a plan view of two blocks selectively interconnected with removable wires.

The blocks may have any shape or size. A set of blocks may be of the same shape and size or may be different. For example, sizes may include 31-mm square, 1-inch square, 3-inch square, or any other size. The blocks may be in the shape of square, rectangles, triangle, circles, or any other shape. Horizontal surfaces of the blocks may be printed circuit board (PCB) or any other material, for example, plastic, wood or ceramic. The horizontal surface may include insulative material. The posts may be placed in the corner of the blocks or at other locations. An embodiment, shown in the plan view of FIG. 19, includes two wooden boards 230, 232 with coupling holes 234 distributed around their peripheries. Pairs of terminal posts 236, 238 project above the boards 230, 232 at interior positions away from the board peripheries. A battery pack 240 is mounted on the first board 230 and is coupled by two unillustrated wirings to its terminal posts 236. A motor 242 with its output shaft 244 is mounted on the second board 232 and is coupled by two unillustrated wirings to its terminals 238. Flexible wires 246, 248 are coupled between the terminal posts 236, 238 by manually operated alligator clips 239. Rearranging the connections may cause the motor 242 to reverse the direction of the rotation of the output shaft 244.

Figure 20A:
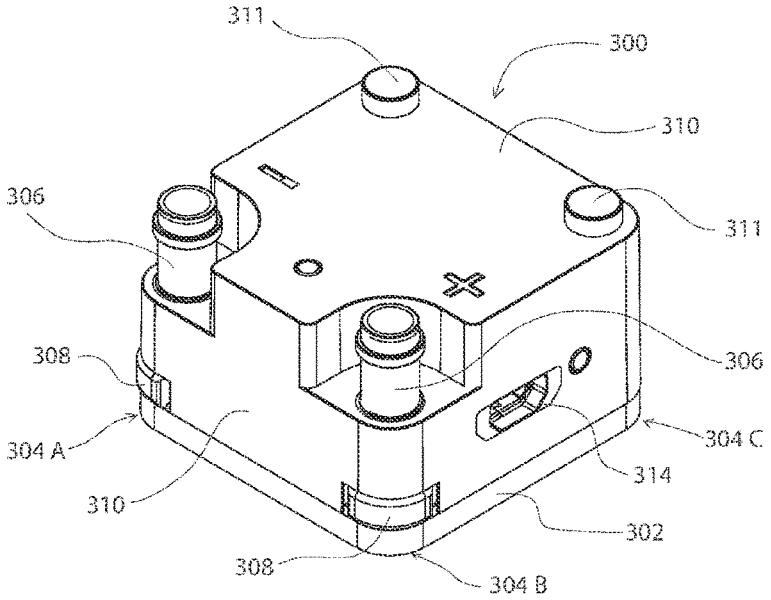
FIGS. 20A-20C depict an example circuit block.

FIG. 20A is a perspective view of another example block 300. Block 300, which may also be referred to herein as a "battery block" or "battery cube," includes a cap 302, corners 304A-304C, and electrical posts 306. Cap 302, which may also be referred to herein as a "base," may comprise, for example, a non-conductive material. More specifically, cap 302 may comprise a plastic, transparent cap. Although three corners 304A-304C are illustrated in FIG. 20A and a fourth corner is implied by the perspective view of FIG. 20A, block 300 may include any number of corners. As illustrated, block 300 includes corner contacts 308, wherein corners 304A and 304B each include corner contact 308. As described more fully herein, corner contact 308, which may comprise conductive material, may be coupled (e.g., electrically and/or mechanically) to a substrate (not shown in FIG. 20A), and/or a post (e.g., electrical post 306) and may be configured to maintain a magnet within block 300. Block 300 may include an electrical component such as a battery (not shown) which may have terminals that are electrically coupled to one or more posts and/or one or more corner contacts 308.

Block 300 further includes a frame 310, which may include a non-conductive material, such as plastic. Further, block 300 may include posts 311, which may also include a non-conductive material, and may be configured for coupling to another device, such as another block or a LEGO®. For example, posts 311 may be part of frame 310, or frame 310 may be positioned at least partially around posts 311. In some embodiments, block 300 may include an electrical port (e.g., charging port) 314 exposed through frame 310 and configured to receive a device, such as a connector (e.g., USB connector).

Figure 20B:
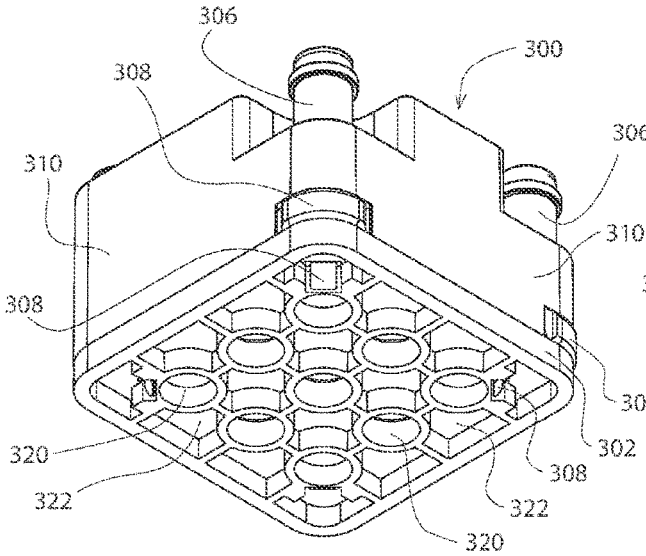
Figure 20C:
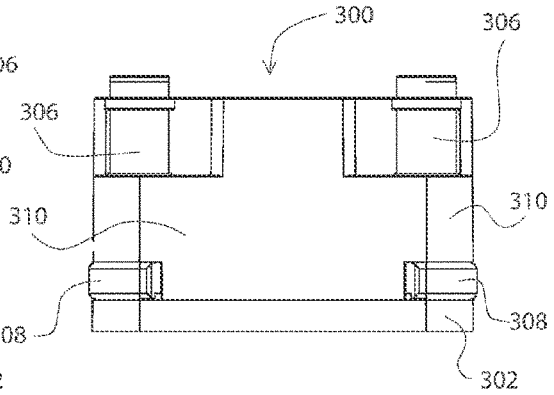

FIG. 20B is a bottom perspective view of block 300. As illustrated, cap 302 of block 300 includes holes 320 and recesses 322, which may be configured to enable block 300 to couple (e.g., mechanically and/or electrically) to another device, such as another block and/or a LEGO®. As described more fully below, according to various embodiments, at least a portion of corner contact 308 may protrude through cap 302 to enable electrical connection to another block (e.g., a post of another block in a stacked configuration). FIG. 20C is a side-view of block 300 illustrating corner contacts 308, frame 310, and electrical posts 306.

Figure 21A:
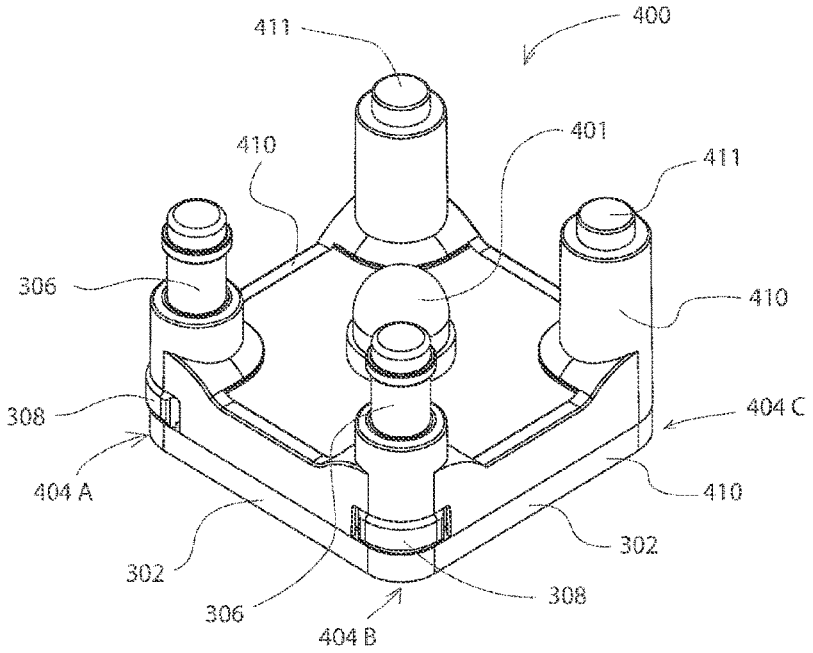
FIGS. 21A-21C depict another example circuit block.

FIG. 21A is a perspective view of another example block 400. Block 400, which may also be referred to herein as a "LED block" or "LED cube," includes an LED 401, cap 302, corners 404A-404C, and electrical posts 306. Although three corners 404A-404C are illustrated in FIG. 21A and a fourth corner is implied by the perspective view of FIG. 21A, block 400 may include any number of corners. As illustrated, block 400 includes corner contacts 308, wherein corners 404A and 404B each include a contact. As described more fully herein, corner contact 308, which may comprise conductive material, may be electrically and/or mechanically coupled to an electrical post 306 and may be configured to maintain a magnet within block 400. LED 401 may include electrical contacts that may be electrically coupled to the electrical posts 306 and/or corner contacts 308.

Block 400 further includes a frame 410, which may include a non-conductive material, such as plastic. Further, block 400 may include posts 411, which may also include a non-conductive material, and may be configured for coupling to another device, such as another block or a LEGO®. For example, posts 411 may be part of frame 410, or frame 410 may be positioned at least partially around posts 411.

Figure 21B:
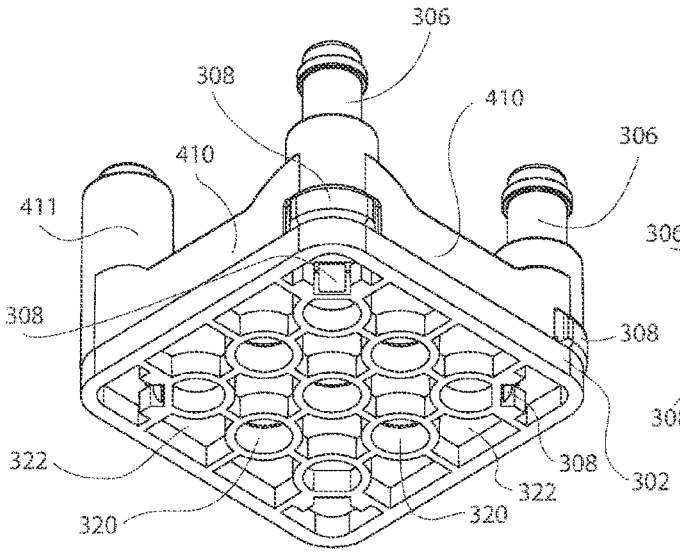
Figure 21C:
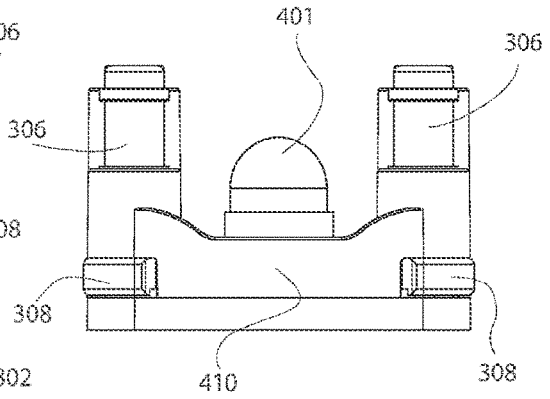

FIG. 21B is a bottom perspective view of block 400. As illustrated, cap 302 of block 400 includes holes 320 and recesses 322, which may be configured to enable block 300 to couple (e.g., mechanically and/or electrically) to another device, such as another block and/or a LEGO®. According to various embodiments, at least a portion of corner contact 308 may protrude through cap 302 to enable electrical connection to another block (e.g., a post of another block in a stacked configuration). FIG. 21C is a side-view of block 400 illustrating LED 401, corner contacts 308, frame 410, and electrical posts 306.

Figure 22A:
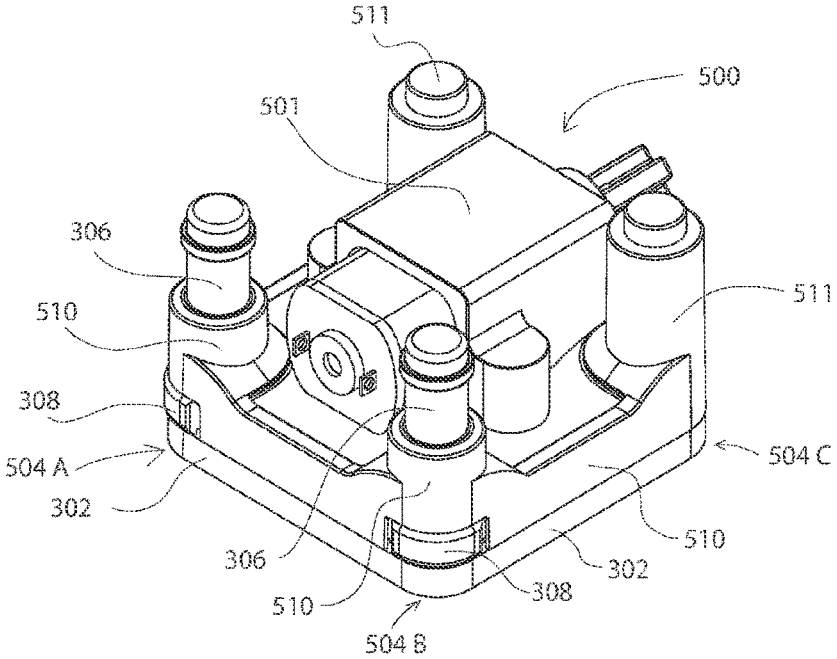
FIGS. 22A-22C depict yet another example circuit block.

FIG. 22A is a perspective view of another example block 500. Block 500, which may also be referred to herein as a "motor block" or a "motor cube," includes a motor 501, cap 302, corners 504A-504C, and electrical posts 306. Although three corners 504A-504C are illustrated in FIG. 22A and a fourth corner is implied by the perspective view of FIG. 22A, block 500 may include any number of corners. As illustrated, block 500 includes corner contacts 308, wherein corners 504A and 504B each include a contact. As described more fully herein, corner contact 308, which may comprise conductive material, may be coupled to a post and may be configured to maintain a magnet within block 500.

Block 500 further includes a frame 510, which may include a non-conductive material, such as plastic. Further, block 500 may include posts 511, which may also include a non-conductive material, and may be configured for coupling to another device, such as another block or a LEGO®. For example, posts 511 may be part of frame 510, or frame 510 may be positioned at least partially around posts 511.

Figure 22B:
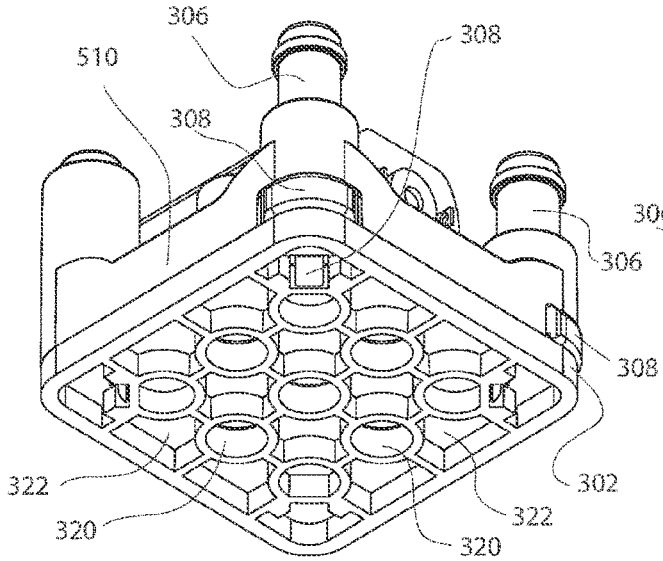
Figure 22C:
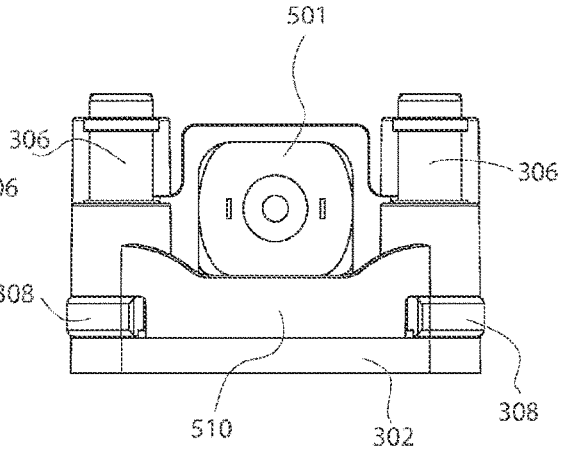

FIG. 22B is a bottom perspective view of block 500. As illustrated, cap 302 of block 500 includes holes 320 and recesses 322, which may be configured to enable block 500 to couple (e.g., mechanically and/or electrically) to another device, such as another block and/or a LEGO®. According to various embodiments, at least a portion of corner contact 308 may protrude through cap 302 to enable electrical connection to another block (e.g., a post of another block in a stacked configuration). FIG. 22C is a side-view of block 500 illustrating motor 501, corner contacts 308, frame 510, and electrical posts 306.

According to some embodiments, corner contact 308 may include one or more pieces. For example, corner contact 308 may include a continuous piece of material (e.g., metal), or corner contact 308 may include more than one piece (e.g., two pieces) of material that are coupled (e.g., electrically coupled) together. Further, in some embodiments, at least a portion of corner contact 308 may be configured to project outwardly from a frame (e.g., frame 310, frame 410, or frame 510) and beyond an outer surface of the frame and/or a cap (e.g., cap 302). Stated another way, an outer surface of a corner section of a contact may be configured to project outwardly from a frame of the block and extend to or beyond a peripheral surface of a block (e.g., a frame and/or a cap of the block). Thereby, when two blocks are placed side by side, the contacts of two blocks may be closely coupled. If the magnetic polarities of the magnets within the blocks are selected such that the nearest points of the juxtaposed magnets have opposite magnetic polarities, the two magnets and hence their blocks may be attracted to each other and contacts of the two blocks may touch. When corner contacts 308 are electrically conducting and electrically coupled to electrical posts 306, touching contacts may provide a conducting path between posts and/or electrical components of the neighboring blocks.

Further, when the corners of the two blocks are positioned near one another, the magnets in the blocks may be attracted to each other and may cause one or more of the blocks to rotate such that the magnetization directions become aligned and the attractive force causes the contacts to touch and establish electrical coupling between the blocks. A contact, as described herein, may provide for electrical coupling in multiple directions. For example, a contact may provide electrically coupling in a vertical (e.g., upward and downward directions) and/or one or more horizontal directions.

Figure 23:
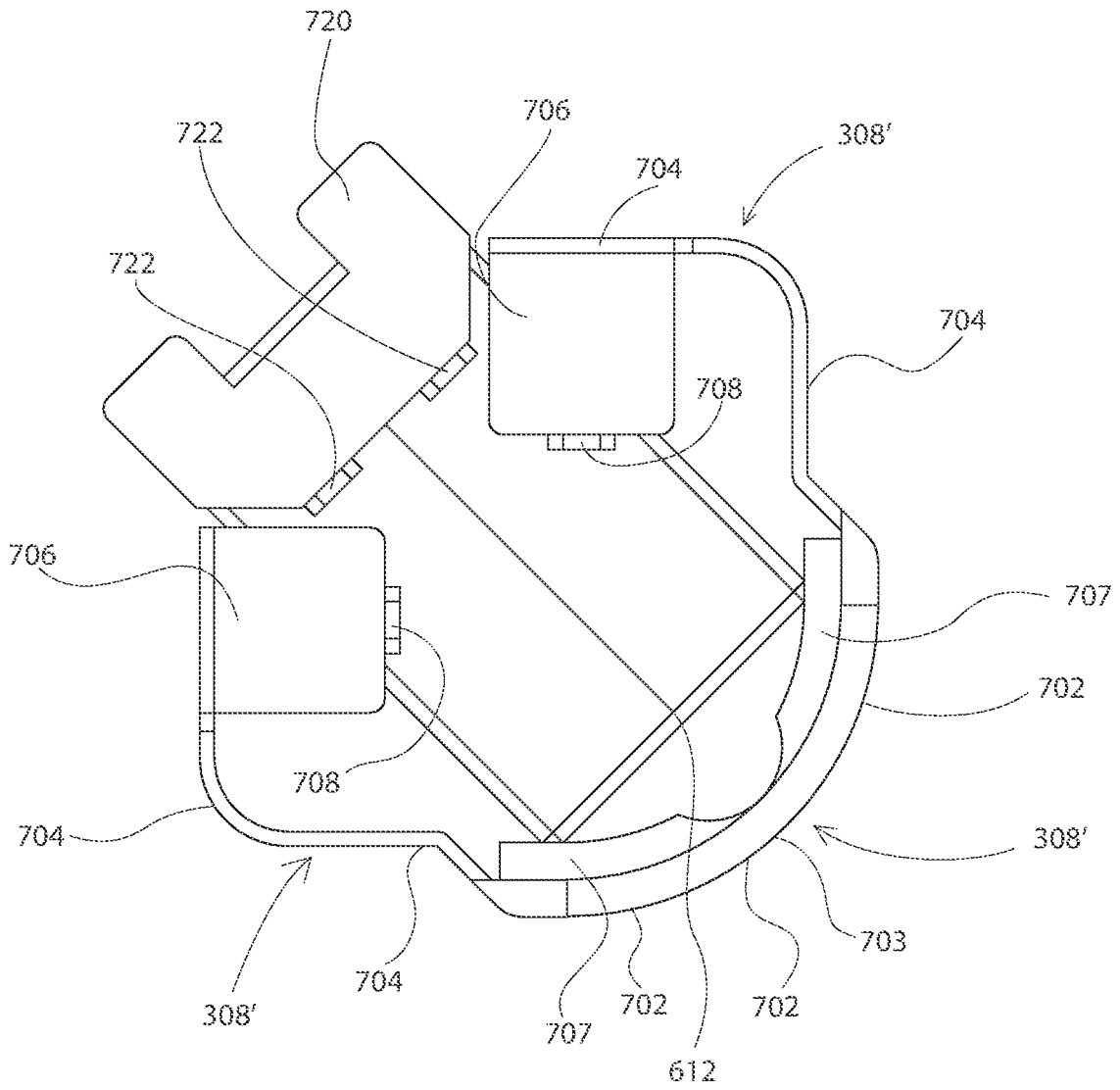
FIG. 23 illustrates an example contact and a magnet.

FIG. 23 depicts an example contact 308', which may include corner contact 308 shown in FIGS. 20A-22C. Contact 308' includes a corner section 702 (e.g., a curved corner section), and may be sized and configured for being positioned at a corner of a block (e.g., block 300, block 400, and block 500). Corner section 702 may include an outer edge 703 and an inner edge (not shown in FIG. 23; see inner edge 805 of FIG. 24), which is opposite the outer edge 703. Corner section 702 may include a curve including a suitable curvature. For example, corner section 702 may include a 90 degree curve, or a curve that is less than or greater than 90 degrees. In some examples, with reference to FIG. 21A for example, corner contact 308 may include a corner section 702 (see FIG. 23) that may extend from a first side of block 400 to a second side of block 400, which is substantially perpendicular to the first side of block 400. The curved corner sections 702 may enable electrical contact between two blocks over a variety of relative angles between the blocks. Stated another way, for example, when two blocks are resting on the same plane (e.g., a table top), in corner-to-corner contact, and electrically coupled via their respective corner contacts 308, the relative angle between the two blocks may be changed from 0 to 180 degrees while still maintaining electrical contact between the two blocks.

In some embodiments, corner section 702 may include a flexible, conductive material configured to be temporally displaced (e.g., toward a magnet 612) in response to a force applied to the outer edge 703. Corner section 702 may return to its default position and/or configuration upon removal of the applied force. The applied force may come from the corner section of a second block. For example, two blocks may be individually coupled to a LEGO® block such that their corner sections contact. For example, the spacing of the cylindrical studs 26 on the LEGO® block and the holes 320 and recesses 322 on the caps may be such that the sections of two blocks interfere with each other, creating a force that in turn causes displacement of the corner sections.

Contact 308' may further include at least one lip section 707 extending from outer edge 703 in a direction substantially perpendicular to the outer edge 703. Further, contact 308' may include at least one additional section 704 extending from the curved corner section 702. Section 704 may include a flexible material. In some embodiments, the displacement of corner section 702 in response to a force may come from flexibility in one or both of the sections 704 instead of, or in addition to, flexibility in corner section 702. For example, the material of corner section 702 may be ridged while the material of sections 704 may be flexible allowing corner section 702 to be temporally displaced. Moreover, contact 308' may include at least one section 706 and a tab 708 coupled to the at least one additional section 704 via section 706. Section 704 may include a curved section extending from corner section 702 to section 706. Section 706 may be configured to be positioned proximate a substrate, and in some embodiments, may contact and/or couple (e.g., electrically and/or mechanically) to the substrate. Tabs 708, 722, which may include, for example, a solder tab, may be configured to couple (e.g., electrically and/or mechanically) to a substrate (not shown in FIG. 23). In some embodiments, tabs 708, 722 may be positioned within and coupled to (e.g., soldered or press fit) a hole (e.g., a metallized through hole) in the substrate. The substrate may comprise, for example, a PCB.

In addition, in some embodiments, contact 308' may include retainer section 720 opposite the corner section 702 and configured to couple (e.g., electrically and/or mechanically) to the substrate. In various embodiments, the corner section 702 (the inner edge 805), the at least one additional section 704, and the retainer section 720 form an inner region of contact 308' configured to receive and retain the magnet 612.

Figure 24:
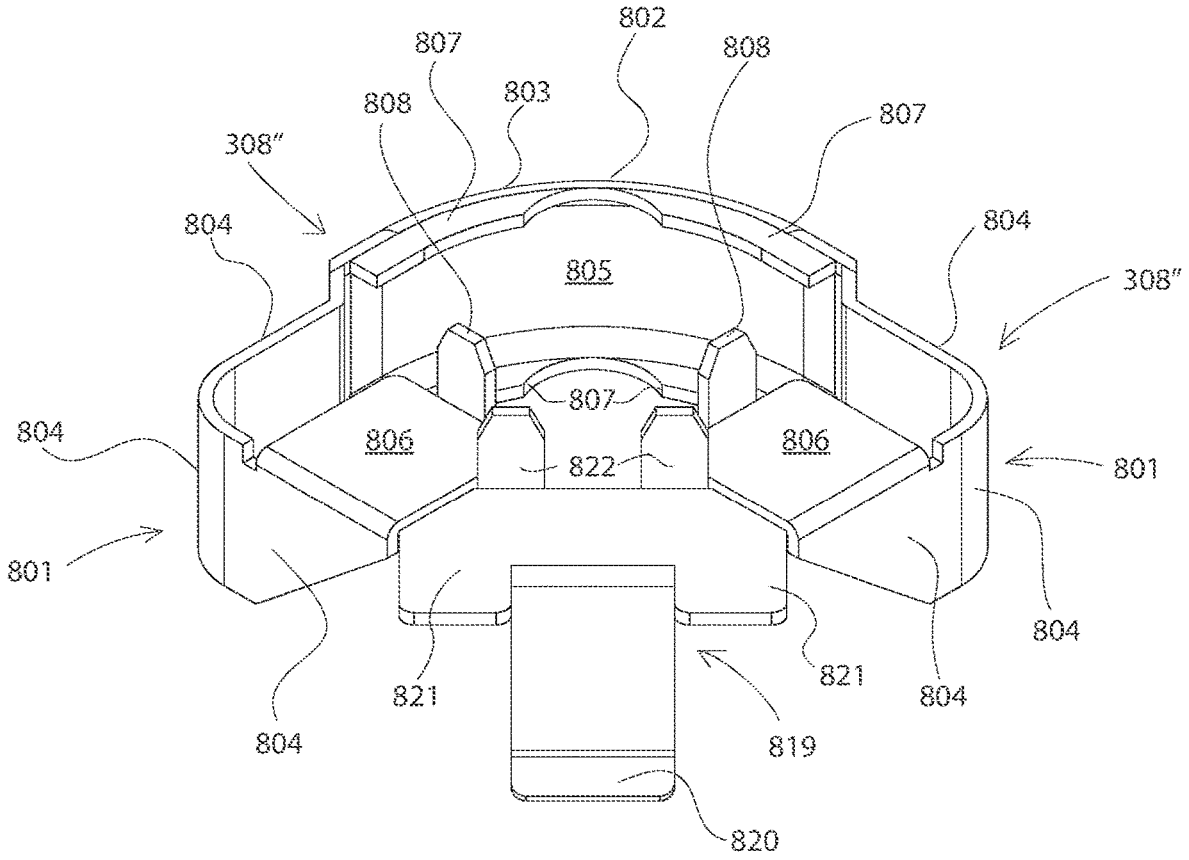
FIG. 24 illustrates another example contact.

FIG. 24 illustrates another example contact 308", which may include corner contact 308 shown in FIGS. 20A-22C. In the embodiment illustrated in FIG. 24, contact 308" includes more than one piece of material. More specifically, contact 308" may include a first portion 801 (e.g., including metal) and a second portion 819 (e.g., including metal).

Contact 308" includes a corner section (e.g., a curved corner section) 802, and may be sized and configured for being positioned at a corner of a block (e.g., block 300, block 400, and block 500). Corner section 802 may include an outer edge 803 and an inner edge 805, which is opposite the outer edge 803. In some embodiments, the corner section 802 may include a flexible, conductive material configured to be displaced in response to a force applied to the outer edge 803. Corner section 802 may return to its default position and/or configuration upon removal of the applied force.

Contact 308" further includes at least one lip section 807 extending from the outer edge 803 in a direction substantially perpendicular to the outer edge 803. Further, contact 308" may include at least one additional section 804 extending from the corner section 802. Section 804 may include a flexible material. The displacement of corner section 802 in response to a force may come from one or both of flexibility in section 804 and corner section 802. Moreover, contact 308" may include sections 806 and tabs 808. Section 806 may be configured to contact and/or couple (e.g., electrically and/or mechanically) to a substrate. Further, tabs 808, which may include, for example, solder tabs, may be configured to couple (e.g., electrically and/or mechanically) to the substrate. In some embodiments, tabs 808 may be positioned within and coupled to (e.g., soldered or press fit) a hole (e.g., a metallized through hole) in the substrate. The substrate may comprise, for example, a PCB.

In addition, in some embodiments, portion 819 may include a retainer section 820, a section 821, and tabs 822. In some embodiments, section 821 may be positioned adjacent, and possibly coupled to a substrate, and tabs 822, which may include, for example, solder tabs, may be configured to couple (e.g., electrically and/or mechanically) to the substrate. In some embodiments, tabs 822 may be positioned within and coupled to (e.g., soldered or press fit) a hole (e.g., a metallized through hole) in the substrate. Retainer section 820 may be configured to assist in maintaining a magnet, and may further be configured to protrude through an opening in a cap (e.g., cap 302; see e.g., FIG. 20B) to electrically contact another device, such as another block (e.g., an electrical post of another block in a stacked configuration). Retainer section 820 may include a flexible, conductive material configured to be temporally displaced (e.g., away from the corner section 802) in response to the head of a post of another block pressing against it when two blocks are stacked. This may enable the retainer section 820 to make reliable electrical contact with the post of the other block (e.g., in a stacked configuration). In various embodiments, the corner section 802 and the sections 804 comprise a first piece of metal, and the portion 819 including retainer section 820 comprises a second, different piece of metal as shown in FIG. 24. In various other embodiments, the corner section 802, the sections 804, and the portion 819, including retainer section 820 comprise a continuous piece of metal. It is noted that the term "section" may also be referred to herein as a "member."

Figure 25A:
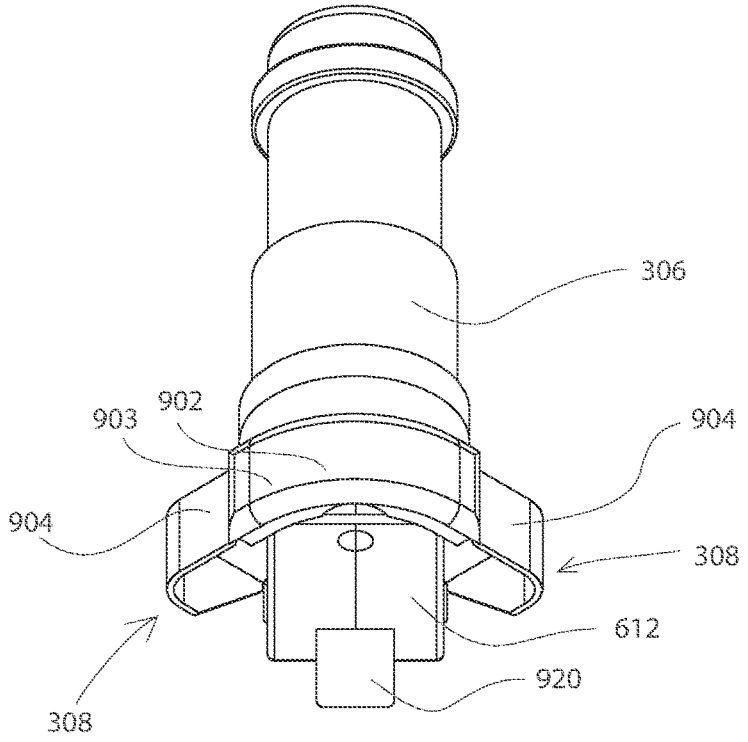
FIGS. 25A and 25B depict an example contact and an electrical post.
Figure 25B:
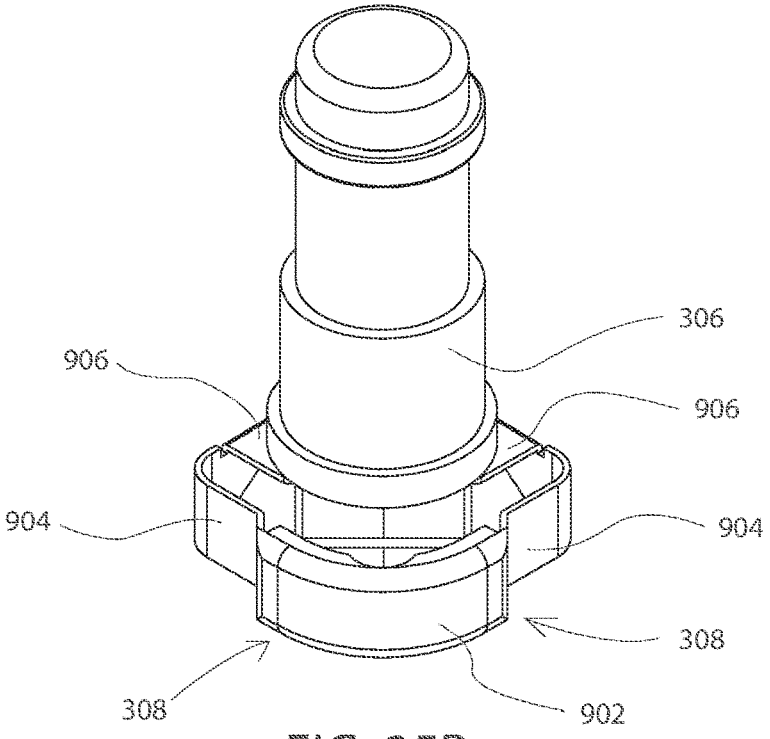

FIG. 25A illustrates corner contact 308, electrical post 306, and magnet 612. Corner contact 308, which may include contact 308' or contact 308", includes corner section 902, which may include, for example corner section 702 (see FIG. 23) or corner section 802 (see FIG. 24). Corner section 902 may include a flexible, conductive material configured to be displaced in response to a force applied to the outer edge 903. In addition, corner contact 308 includes retainer section 920, which may be configured to assist in maintaining the magnet 612, and may further be configured to protrude through an opening in a cap (e.g., cap 302; see e.g., FIG. 20B) to electrically contact another block (e.g., an electrical post of another block in a stacked configuration). FIG. 25B is another illustration of corner contact 308, including sections 902, 904, and 906, and electrical post 306.

Figure 26A:
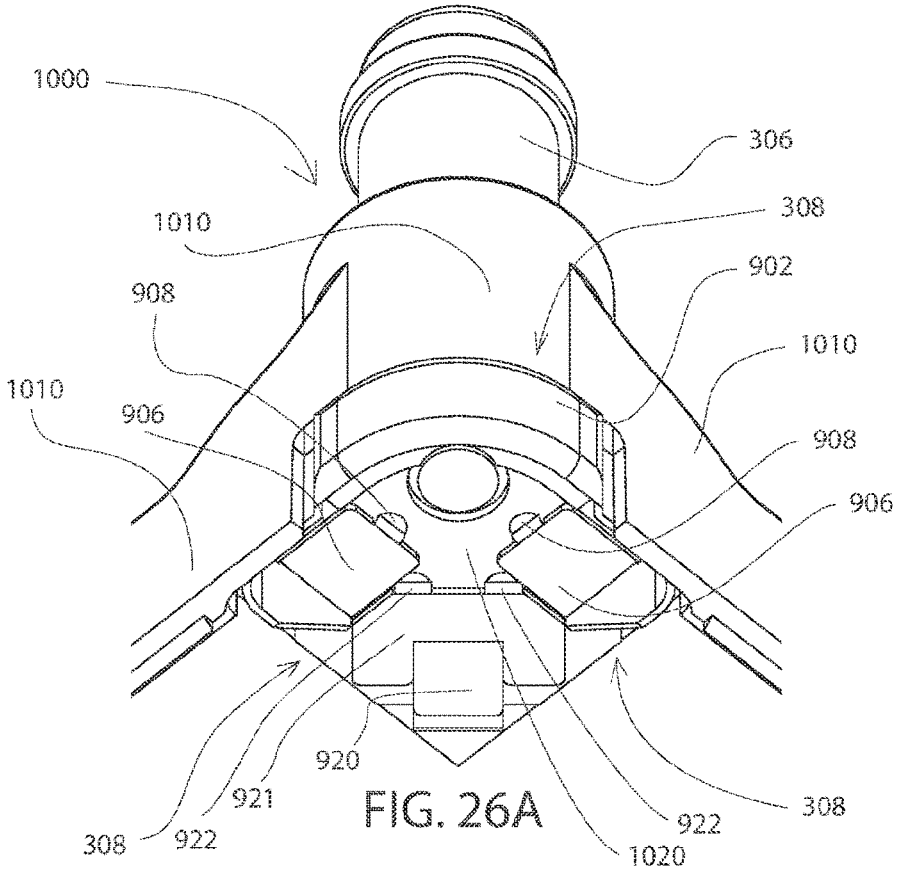
FIGS. 26A and 26B illustrate a portion of a circuit block including a contact, an electrical post, and a frame.
Figure 26B:
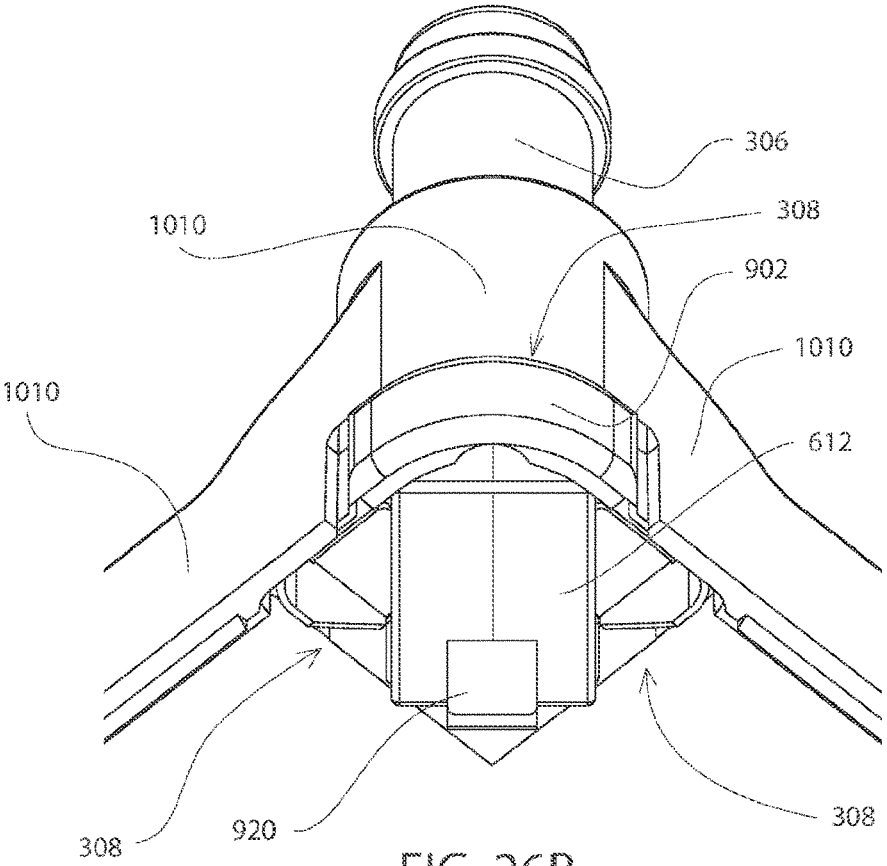

FIG. 26A depicts a portion of a block 1000 including corner contact 308, electrical post 306, and a frame 1010. Corner contact 308 includes corner section 902, sections 906 and 921, tabs 908 and 922, and retainer section 920. According to various embodiments, section 906 and/or section 921 may be positioned adjacent, and possibly coupled to a substrate 1020. Further, according to various embodiments, tabs 908 and/or tabs 922 may be configured to couple (e.g., electrically and/or mechanically) to the substrate 1020. In some embodiments, tabs 908 and/or 922 may be positioned within and coupled to (e.g., soldered or press fit) a hole (e.g., a metallized through hole) in the substrate 1020. Substrate 1020 may comprise, for example, a PCB. In some embodiments, frame 1010 may include a non-conductive material. FIG. 26B depicts retainer section 920 of corner contact 308, electrical post 306, frame 1010, and magnet 612. As depicted in FIG. 26B, retainer section 920 may be configured to assist in maintaining the magnet 612 within block 1000.

Figure 27A:
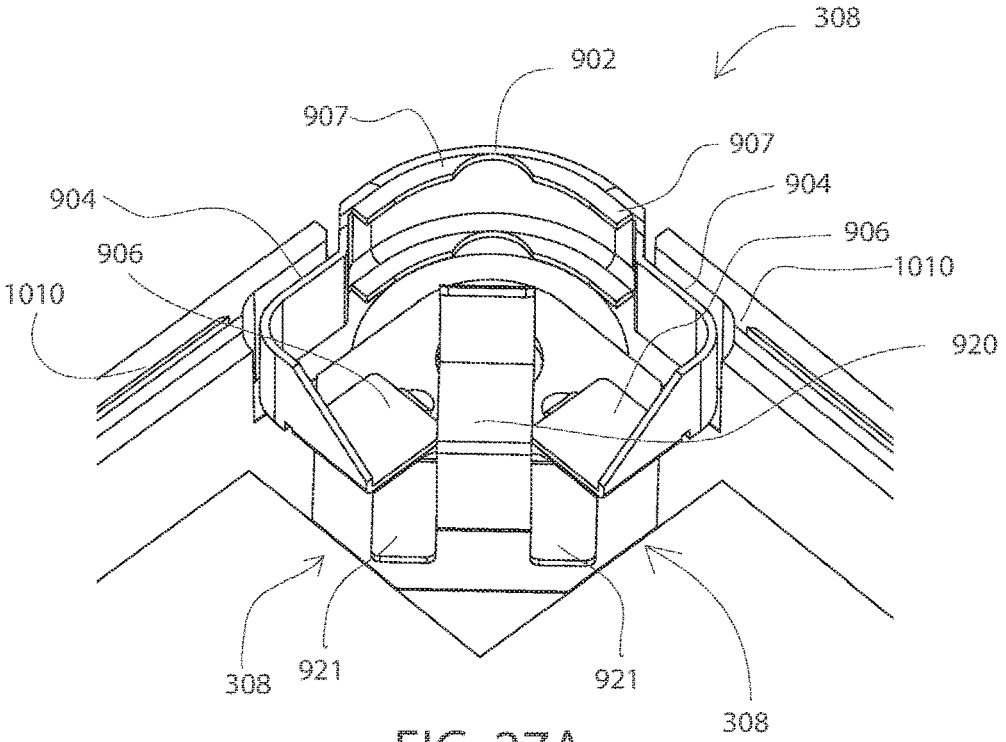
FIGS. 27A and 27B illustrate a portion of a circuit block including a contact, a frame, and a substrate.
Figure 27B:
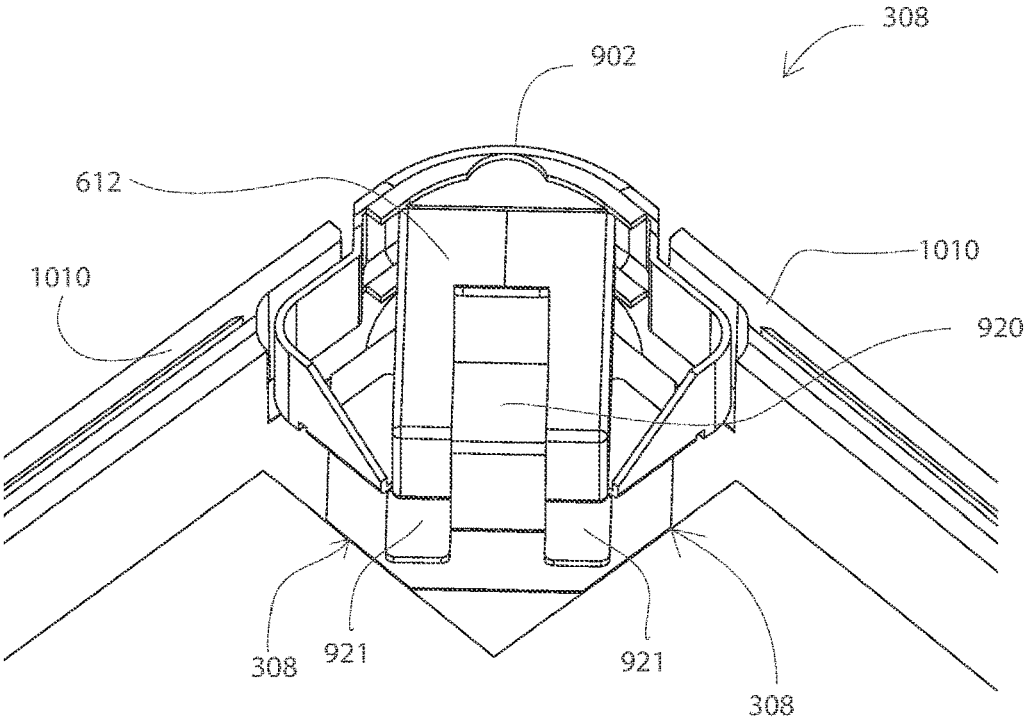

FIG. 27A is another illustration of block 1000 including substrate 1020, frame 1010 and corner contact 308. As shown in FIG. 27A, corner contact 308 includes corner section 902, sections 904, 906, 907, 920, and 921. FIG. 27B illustrates the magnet 612 positioned within an inner region of corner contact 308. It is noted that magnet 612 may be positioned within block 1000 such that an N-pole and an S-pole of the magnet 612 are proximate corner section 902 of corner contact 308.

Figure 28A:
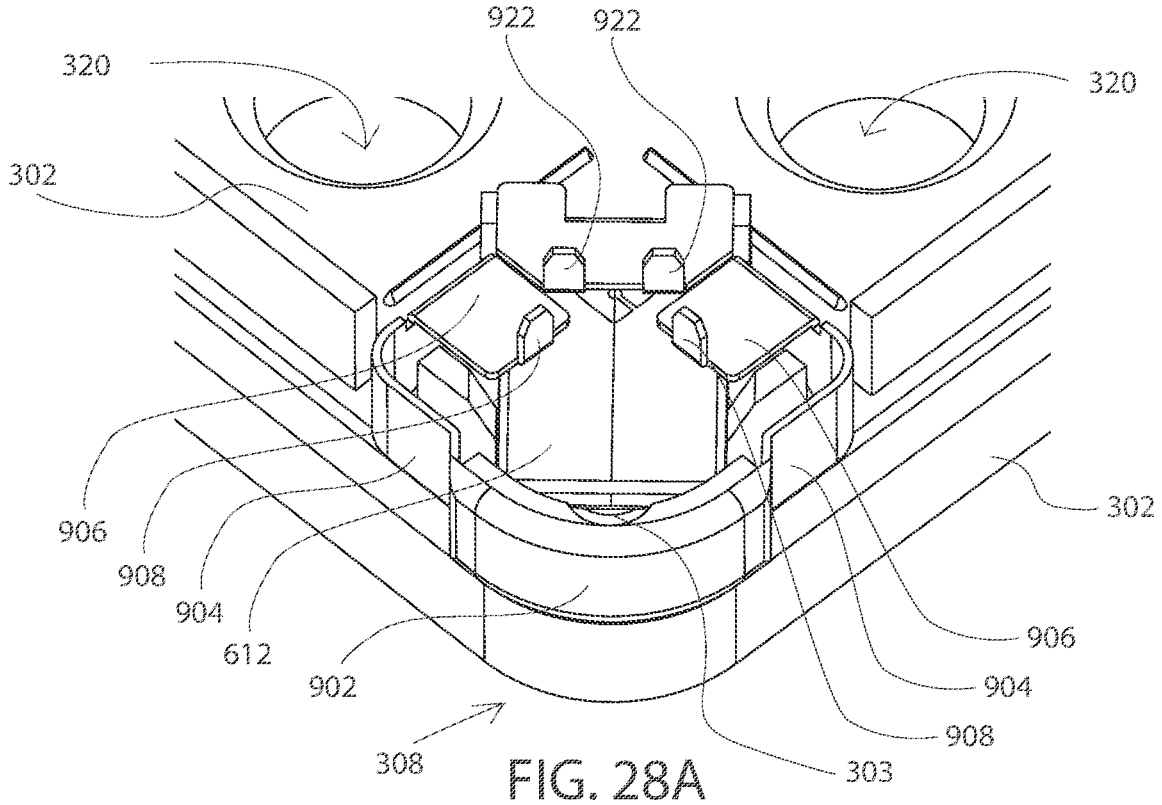
FIGS. 28A and 28B illustrate a portion of a circuit block including a contact, a magnet, and a cap.
Figure 28B:
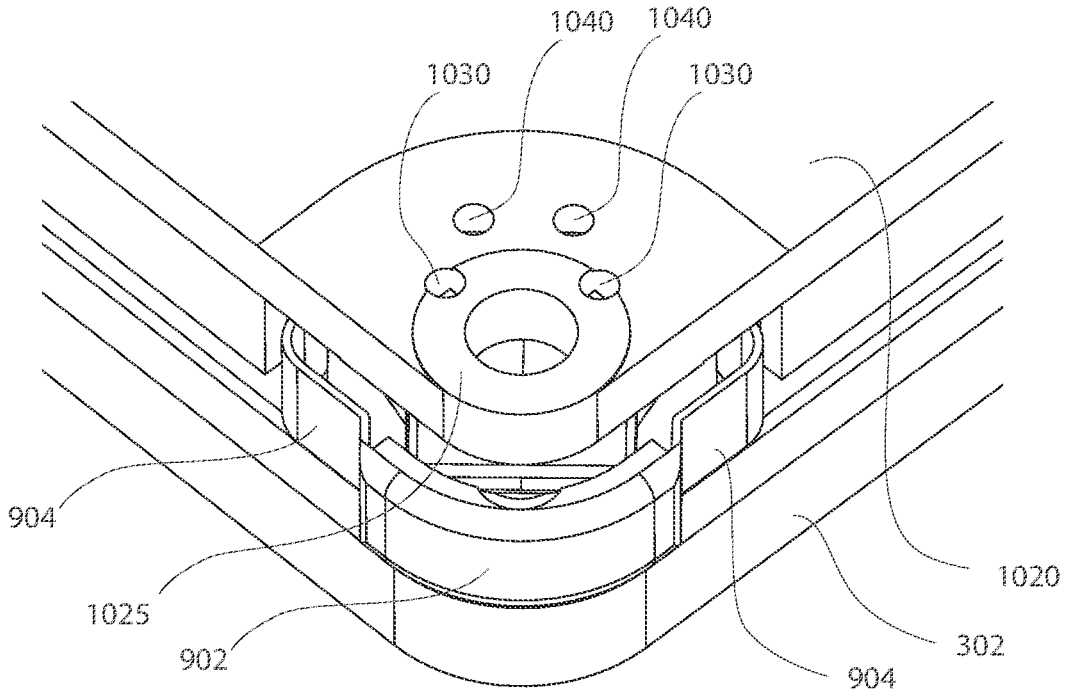

FIG. 28A is another illustration of a portion of block 1000 including corner contact 308 and magnet 612. As illustrated in FIG. 28A, corner contact 308 includes corner section 902, sections 904 and 906, and tabs 908 and 922. FIG. 28A further illustrates cap 302, which includes holes 320. According to some embodiments, at least a portion 303 of cap 302 is configured to be positioned between at least a portion of the at least one magnet (e.g., magnet 612) maintained by corner contact 308 and at least a portion a corner section 902 of corner contact 308. FIG. 28B depicts substrate 1020 positioned adjacent corner contact 308. As illustrated, substrate 1020 may include an electrical trace 1025 configured for electrically coupling to a post (e.g., electrical post 306; see e.g., FIG. 25A). Substrate 1020 may also include holes 1030 and holes 1040. In some embodiments, tabs 908 (see FIG. 28A) of corner contact 308 may be positioned within, and possibly coupled to (e.g., soldered to and/or press fit) holes 1030, and tabs 922 (see FIG. 28A) of corner contact 308 may be positioned within, and possibly coupled to (e.g., soldered to and/or press fit) holes 1040.

Figure 29A:
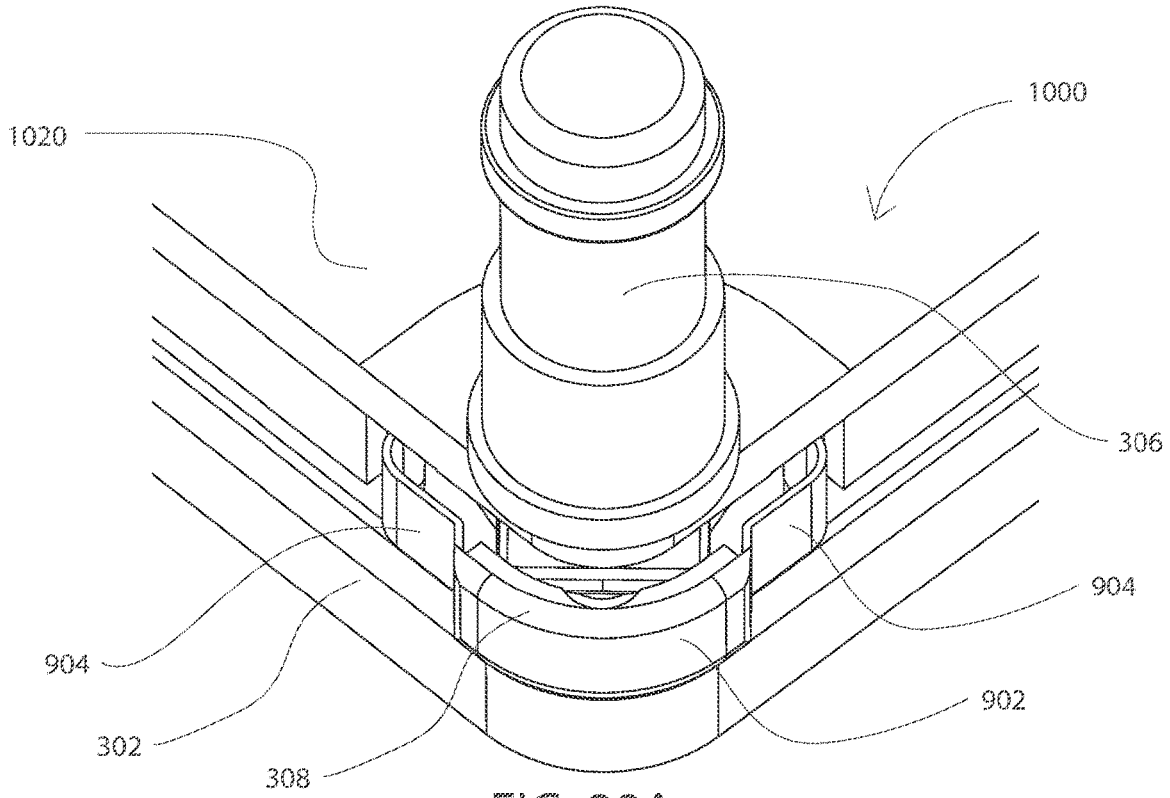
FIGS. 29A and 29B illustrate a portion of a circuit block including a contact, an electrical post, a substrate, and a cap.
Figure 29B:
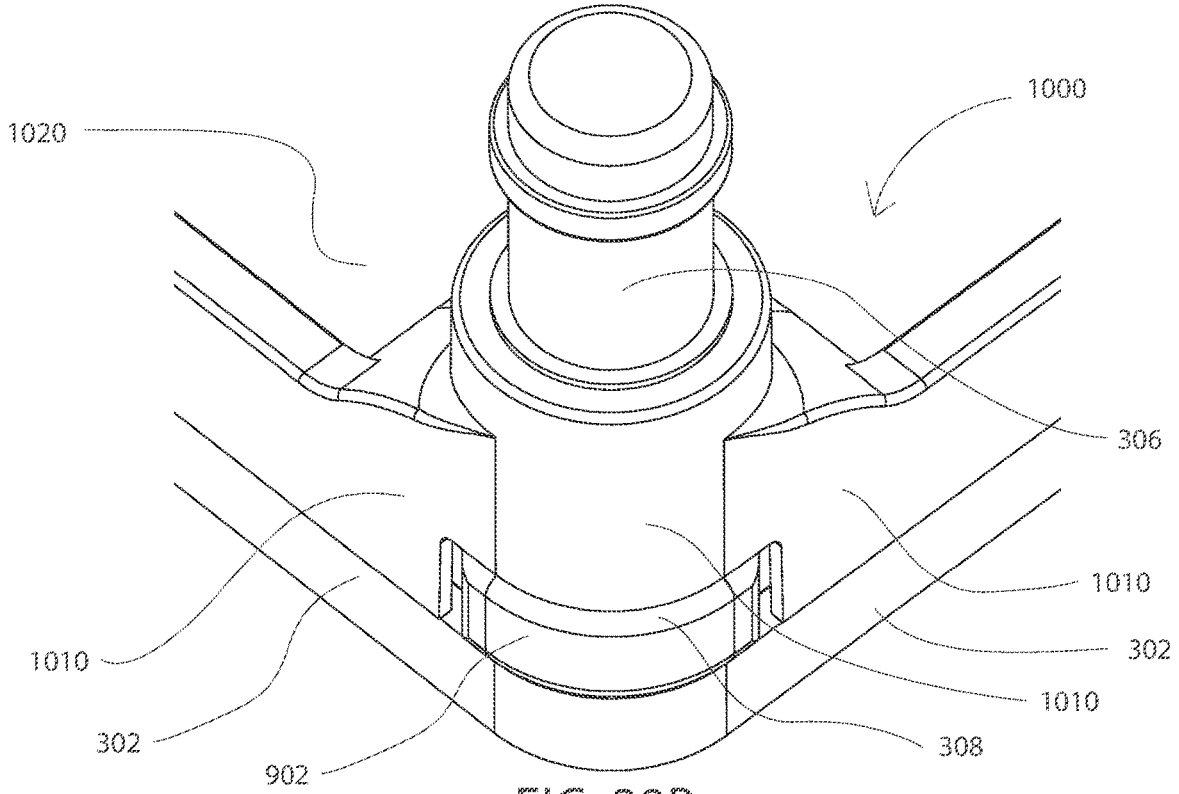

FIG. 29A is another illustration of block 1000 including cap 302, corner section 902 and sections 904 of corner contact 308, electrical post 306, and substrate 1020. FIG. 29B illustrates block 1000 including frame 1010 positioned adjacent substrate 1020, electrical post 306, cap 302, and corner contact 308.

Figure 30A:
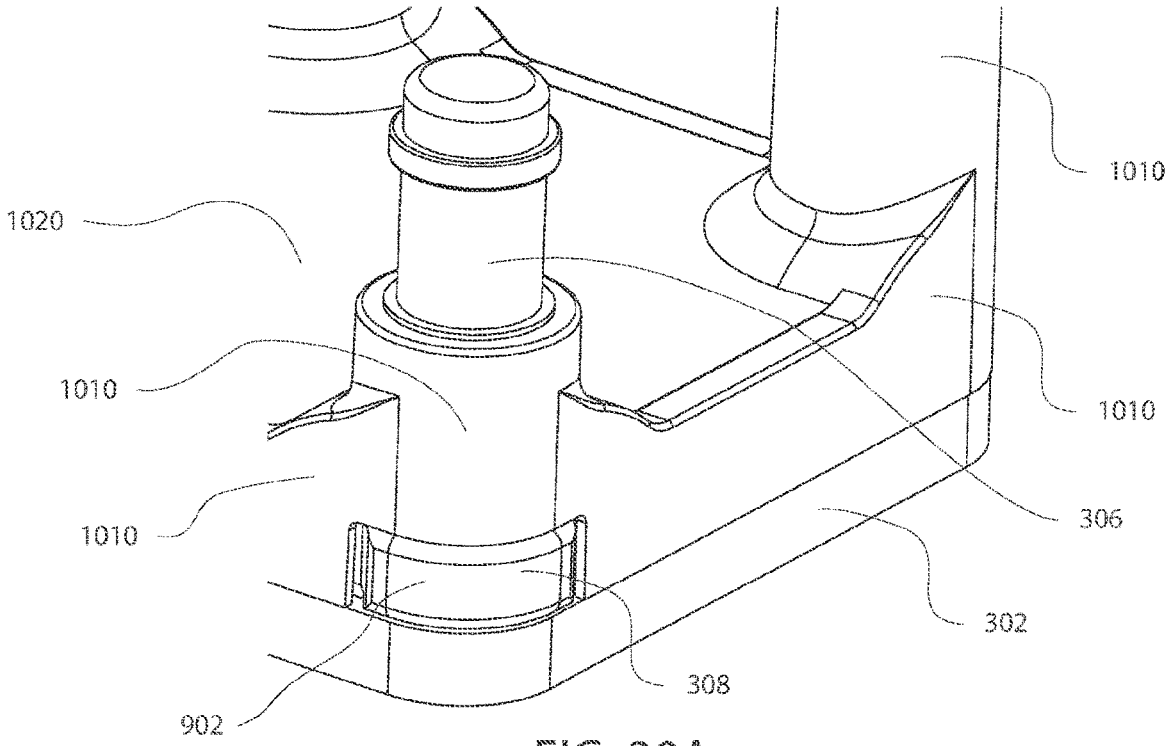
FIGS. 30A and 30B illustrate a portion of a circuit block including a contact, a frame, an electrical post, and a cap.
Figure 30B:
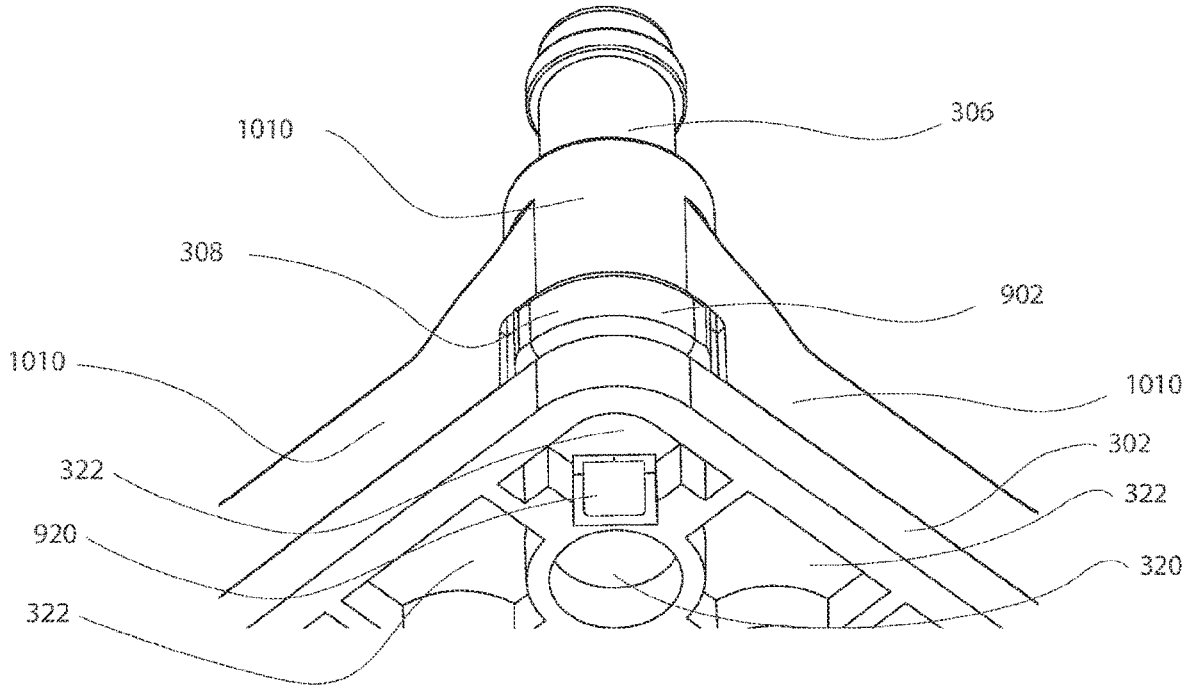

FIG. 30A is another illustration of block 1000 including cap 302, corner section 902 of corner contact 308, electrical post 306, substrate 1020, and frame 1010. FIG. 30B is another illustration of block 1000 depicting cap 302, corner section 902 of corner contact 308, electrical post 306, and frame 1010. Recesses 322 and holes 320 in cap 302 are also illustrated. FIG. 30B further illustrates retainer section 920 of corner contact 308 protruding through cap 302 and configured to contact (e.g., electrically contact) another device (e.g., an electrical post of another block). More specifically, a head of a post of another block may contact the portion of retainer section 920 exposed through cap 302 when the two blocks are stacked. Retainer section 920 of corner contact 308 may include a flexible, conductive material configured to mechanically interfere with, and be temporally displaced (e.g., away from the corner section 902) by, the head of the post of the other block being inserted into recess 322. This may enable the retainer section 920 to make reliable electrical contact with the post of the other block.

Figure 31A:
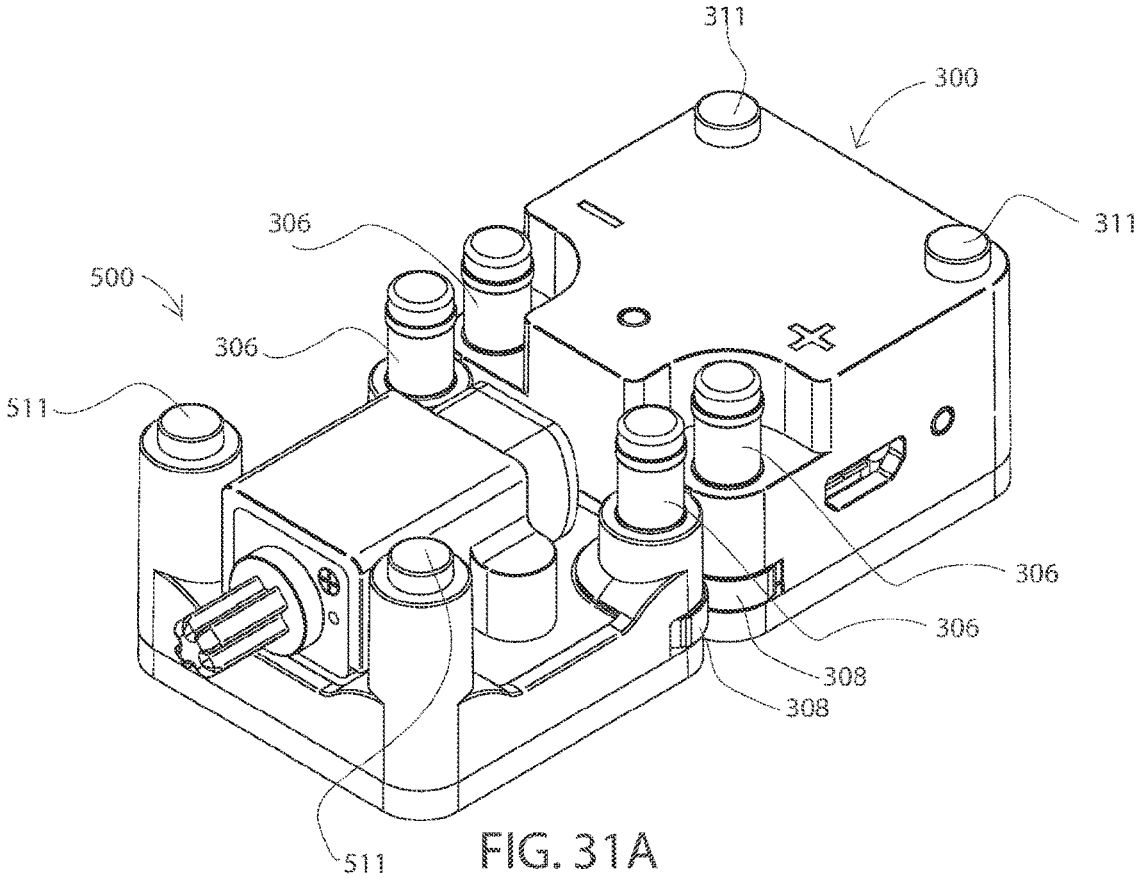
FIGS. 31A and 31B illustrate a plurality of blocks coupled in a horizontal configuration.
Figure 31B:
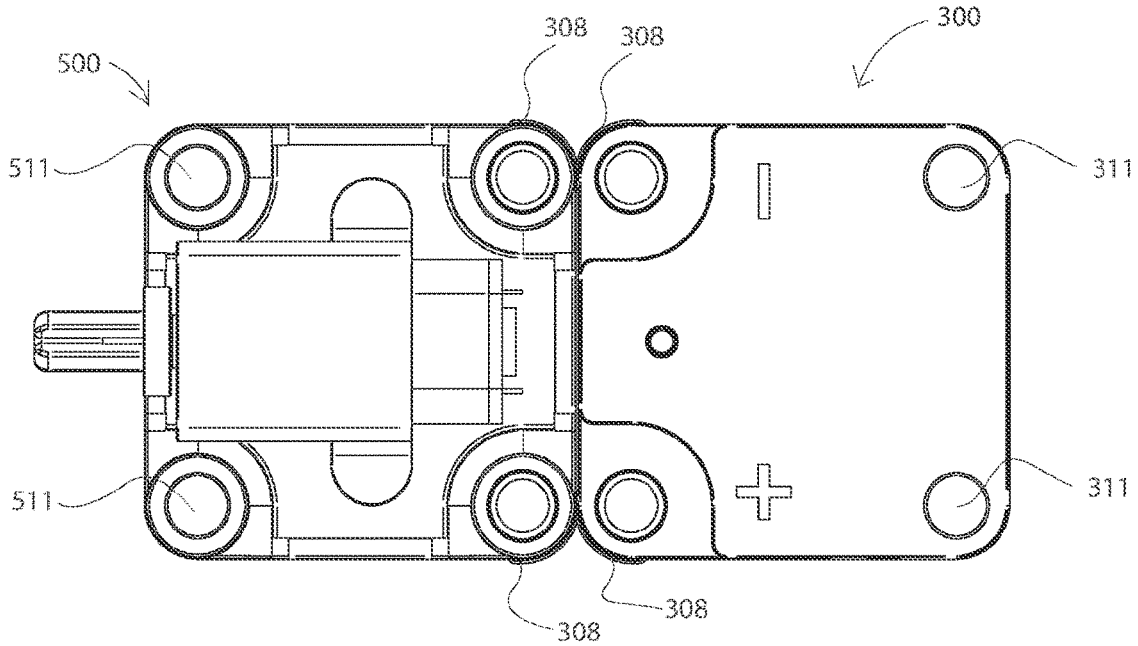

FIGS. 31A and 31B illustrate blocks 300 and 500 coupled in a horizontal configuration. As shown in FIGS. 31A and 31B, blocks 300 and 500 may be coupled (e.g., electrically and/or magnetically) via corner contacts 308.

Figure 32A:
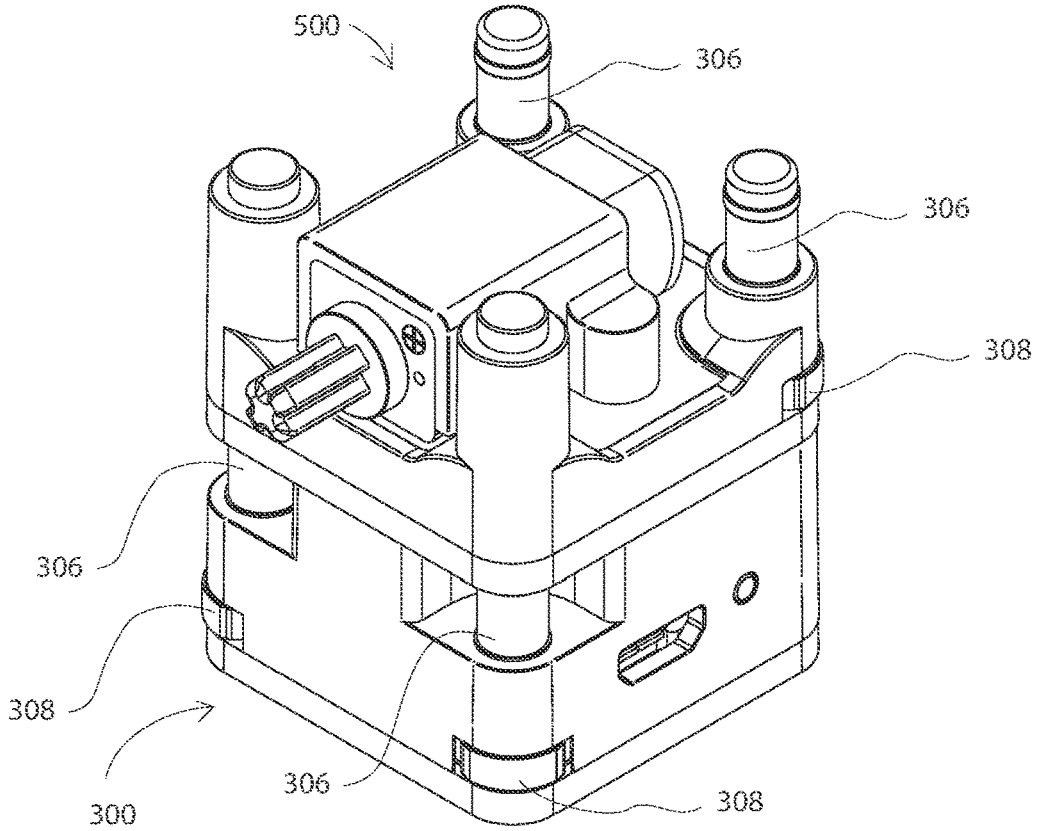
FIGS. 32A and 32B illustrate a plurality of blocks coupled in a vertical configuration.
Figure 32B:
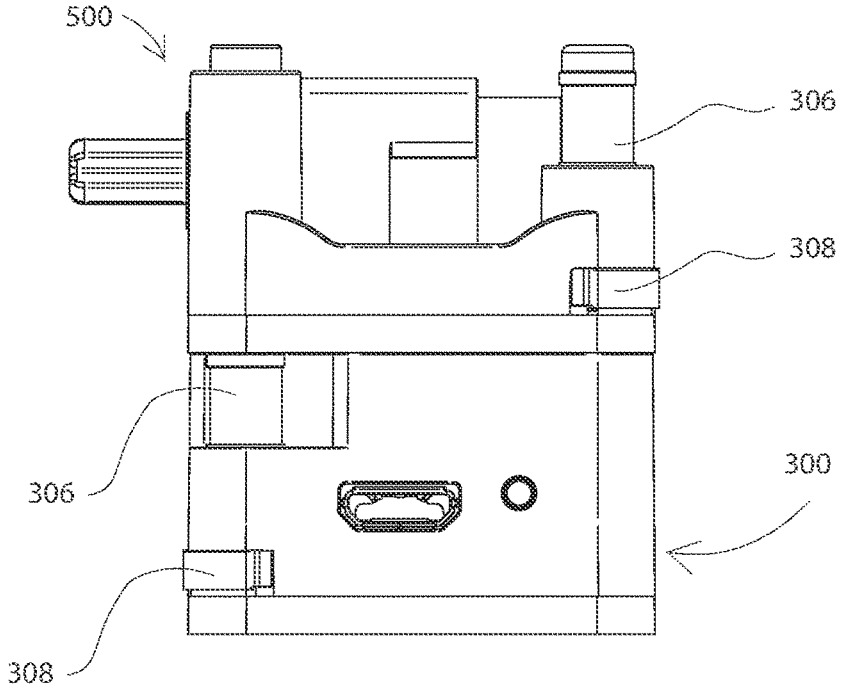

FIGS. 32A and 32B illustrate blocks 300 and 500 coupled in a vertical ("stacked") configuration. As shown in FIGS. 32A and 32B, blocks 300 and 500 may be coupled (e.g., mechanically, magnetically, and/or electrically) via corner contacts 308, electrical posts 306, and/or posts 311/511 (see e.g., FIGS. 20A, 22A, 31A, and 31B).

Although only two blocks are illustrated in each of the configurations of FIGS. 31A, 31B, 32A, and 32B, it will be appreciated that more than two blocks may be coupled in each of a horizontal configuration and a vertical configuration (also referred to herein as a "stacked configuration").

The blocks may be arranged in a linear or a rectangular or other two-dimensional pattern. They may also be arranged in a triangular configuration. For example, three blocks can be assembled with each block touching and contacting each of two neighboring block only on one respective corner in a serial connection around the triangle. Stacking in the third dimension is also possible in this and other embodiments when a lower-level block includes three or more posts or other means supporting one or more upper-level blocks in a stacked configuration.

The electrical component mounted on the circuit boards may be any electrical or electronic device or element. An electronic device includes a semiconducting element having three or more terminals but is included in the more general class of electrical devices as broadly understood. Examples of simple two-terminal electrical components include a resistor, a capacitor, an inductor, a battery, a battery holder, a solar cell, an LED or incandescent light bulbs, a switch, a button, a buzzer, a speaker, wire, a sensor, a motor fan or other electrical device. Other electrical components include a latching push button, a vibrator motor, potentiometer, or geared motor.

Electronic components may include an integrated circuit (IC), a processor, a microprocessor, a computer, an infrared detector or emitter, a Bluetooth circuit, Wi-Fi, wireless, or any other electronic circuit. More than two electrical posts may be required for more complex electrical and electronic devices. According to some embodiments, the electrical component and/or the wiring on the board may be visible to the user (e.g., to facilitate learning). While the disclosure has been described as a toy for youths or an instructional set for course work, it may also be used for professionally prototyping electrical circuits and for other uses.

Terms used in the present disclosure and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

All examples and conditional language recited in the present disclosure are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, various changes, substitutions, and alterations could be made hereto without departing from the spirit and scope of the present disclosure.

What is claimed is:

1. A device, comprising:

a corner section including an outer edge and an inner edge, opposite the outer edge, the corner section including a flexible, conductive material configured to be displaced in response to a force applied to the outer edge;

at least one additional section extending from the corner section;

at least one tab coupled to the at least one additional section and configured to electrically couple to a substrate; and a retainer section opposite the corner section and configured to electrically couple to the substrate;

wherein the inner edge of the corner section, the at least one additional section, and the retainer section are configured to form an inner region configured to receive and retain a magnet.

2. The device of claim 1, wherein the at least one tab comprises two solder tabs.

3. The device of claim 1, wherein the corner section, the at least one additional section, the at least one tab, and the retainer section comprise a continuous piece of metal.

4. The device of claim 1, wherein the corner section, the at least one additional section, and the at least one tab comprise a first piece of metal, and the retainer section comprises a second, different piece of metal.

5. The device of claim 1, wherein the corner section includes a curved surface extending in a first direction and a second direction, the first direction substantially perpendicular to the second direction.

6. The device of claim 1, the corner section including a curved section extending in at least two substantially perpendicular directions and including a flexible, conductive material.

7. The device of claim 1, further comprising a circuit block including the corner section, the at least one additional section, the at least one tab, and the retainer section.

8. A device, comprising:

a circuit block including:

at least one electrically conductive post configured for coupling to at least one other circuit block;

a contact electrically coupled to the at least one electrically conductive post and including a corner section extending in at least two directions substantially perpendicular to a longitudinal axis of the at least one electrically conductive post; and a magnet at least partially retained by the contact and configured to be positioned proximate the corner section of the contact, the magnet and the corner section configured to magnetically attract at least one other circuit block.

9. The device of claim 8, wherein the at least one electrically conductive post comprises ferromagnetic material.

10. The device of claim 8, further comprising a non-conductive frame coupled to the at least one electrically conductive post and including a portion proximate the contact, wherein an outer surface of the corner section of the contact is configured to project outwardly from the frame and beyond a peripheral surface of the frame.

11. The device of claim 8, wherein the circuit block further comprises a frame coupled to the at least one electrically conductive post and including at least one non-conductive post configured for coupling to the at least one other circuit block.

12. The device of claim 8, further comprising a substrate coupled to the at least one electrically conductive post and having a major surface perpendicular to a longitudinal axis of the at least one electrically conductive post.

13. The device of claim 12, wherein the contact further includes at least one tab and at least one additional section coupled between the corner section and the at least one tab, wherein the at least one tab is configured to contact the substrate.

14. The device of claim 8, wherein the at least one electrically conductive post comprises at least two electrically conductive posts, wherein each electrically conductive post is positioned adjacent a corner of the circuit block.

15. The device of claim 8, the corner section including a flexible, conductive material configured to be displaced toward the magnet in response to a force applied to an outer edge of the corner section.

16. The device of claim 8, further comprising:

at least one additional section extending from the corner section;

at least one tab coupled to the at least one additional section and configured to electrically couple to a substrate; and a retainer section opposite the corner section and configured to electrically couple to the substrate;

wherein an inner edge of the corner section, the at least one additional section, and the retainer section are configured to form an inner region configured to receive and retain the magnet.

17. A circuit block, comprising:

at least one post configured for coupling to at least one other circuit block;

a contact electrically coupled to the at least one post and including a curved corner section extending in at least two directions substantially perpendicular to a longitudinal axis of the at least one post; and a magnet at least partially retained by the contact and configured to be positioned proximate the curved corner section of the contact, the magnet and the corner section configured to magnetically attract the at least one other circuit block.

18. The circuit block of claim 17, wherein the circuit block further comprises a frame coupled to the at least one post and including at least one other post configured for coupling to the at least one other circuit block.

19. The circuit block of claim 17, further comprising a substrate coupled to the at least one post and having a major surface perpendicular to a longitudinal axis of the at least one post.

20. The circuit block of claim 17, further comprising:

at least one additional section extending from the curved corner section;

at least one tab coupled to the at least one additional section and configured to electrically couple to a substrate; and a retainer section opposite the curved corner section and configured to electrically couple to the substrate;

wherein an inner edge of the curved corner section, the at least one additional section, and the retainer section are configured to form an inner region configured to receive and retain the magnet.

* * * * *